US010125529B2

(12) United States Patent
Evensen

(10) Patent No.: US 10,125,529 B2
(45) Date of Patent: Nov. 13, 2018

(54) SYSTEM FOR UNLOCKING/LOCKING AND OPENING/CLOSING WINDOWS

(71) Applicant: Reflection Window Company, LLC, Chicago, IL (US)

(72) Inventor: Kenneth R. Evensen, Naperville, IL (US)

(73) Assignee: REFLECTION WINDOW COMPANY, LLC, Chicago, IL (US)

( * ) Notice: Subject to any disclaimer, the term of this patent is extended or adjusted under 35 U.S.C. 154(b) by 291 days.

(21) Appl. No.: 14/711,026

(22) Filed: May 13, 2015

(65) Prior Publication Data

US 2016/0333623 A1 Nov. 17, 2016

(51) Int. Cl.

| | |
|---|---|
| ***E05F 9/00*** | (2006.01) |
| ***E05F 11/00*** | (2006.01) |
| ***E06B 7/04*** | (2006.01) |
| ***E05F 11/24*** | (2006.01) |
| *E05F 3/18* | (2006.01) |
| *E05F 3/22* | (2006.01) |

(52) U.S. Cl.

CPC ..... *E05F 9/00* (2013.01); *E05F 11/00* (2013.01); *E05F 11/24* (2013.01); *E06B 7/04* (2013.01); *E05F 3/18* (2013.01); *E05F 3/22* (2013.01)

(58) Field of Classification Search

CPC ... E05F 9/00; E05F 11/00; E05F 11/02; E05F 3/22; E06B 7/04

USPC ..... 160/246–253; 49/246–253, 275

See application file for complete search history.

(56) References Cited

U.S. PATENT DOCUMENTS

| | | | | | |
|---|---|---|---|---|---|
| 2,767,979 | A * | 10/1956 | Hummert | E05F 11/14 | 49/250 |
| 5,435,103 | A * | 7/1995 | Lauesen | E05F 1/1016 | 49/324 |
| 5,907,926 | A * | 6/1999 | Sosa | E06B 7/086 | 49/249 |
| 6,044,587 | A * | 4/2000 | Vetter | E05F 11/24 | 49/324 |
| 6,230,457 | B1 * | 5/2001 | Brautigam | E05C 9/02 | 292/139 |
| 6,354,639 | B1 * | 3/2002 | Minter | E05C 9/021 | 292/142 |
| 7,614,184 | B2 * | 11/2009 | Rebel | E05F 11/24 | 49/339 |
| 7,807,945 | B2 * | 10/2010 | Ostby | B23K 26/123 | 219/121.67 |
| 9,273,763 | B2 * | 3/2016 | Evensen | F16H 21/44 | |

(Continued)

*Primary Examiner* — Gregory J Strimbu

(74) *Attorney, Agent, or Firm* — McAndrews, Held & Malloy, Ltd.

(57) ABSTRACT

A lever mechanism system includes push arms pivotably coupled to a vent sash and drive arms pivotably coupled to the push arms. The system includes gears coupled to the drive arms and a locking gear slide coupled with a locking mechanism of the sash. The system includes a handle that rotates approximately 180 degrees in a first direction to pivot the gear slide to move the locking mechanism of the sash to an unlocked position and rotates the gears to extend the drive arms and the push arms such that the sash is pushed to an open position. The handle radially rotates approximately 180 degrees in a second direction to rotate the gears to retract the drive arms and the push arms such that the sash is pulled to a closed position and pivots the gear slide to move the locking mechanism of the sash to a locked position.

22 Claims, 20 Drawing Sheets

(56) References Cited

U.S. PATENT DOCUMENTS

| | | | | |
|---|---|---|---|---|
| 2007/0095804 | A1* | 5/2007 | Ostby | B23K 26/123 219/121.72 |
| 2007/0144072 | A1* | 6/2007 | Hansel | E05F 11/34 49/246 |
| 2008/0066382 | A1* | 3/2008 | Erickson | E05B 1/0092 49/246 |
| 2013/0255155 | A1* | 10/2013 | Tang | E05D 7/00 49/67 |
| 2014/0007720 | A1* | 1/2014 | Evensen | F16H 21/44 74/102 |
| 2014/0007734 | A1* | 1/2014 | Evensen | E05F 11/02 74/522.5 |

* cited by examiner

PRIOR ART

PRIOR ART

SYSTEM FOR UNLOCKING/LOCKING AND OPENING/CLOSING WINDOWS

CROSS-REFERENCE TO RELATED APPLICATIONS/INCORPORATION BY REFERENCE

U.S. patent application Ser. No. 13/540,878, by Evensen, published Jan. 9, 2014 as U.S. Publication No. 2014/0007734, issued Aug. 2, 2016 as U.S. Pat. No. 9,404,302, is incorporated by reference herein in its entirety.

U.S. patent application Ser. No. 13/663,798, by Evensen, published Jan. 9, 2014 as U.S. Publication No. 2014/0007720, issued Mar. 1, 2016 as U.S. Pat. No. 9,273,763, is incorporated by reference herein in its entirety.

FEDERALLY SPONSORED RESEARCH OR DEVELOPMENT

[Not Applicable]

MICROFICHE/COPYRIGHT REFERENCE

[Not Applicable]

FIELD OF THE INVENTION

Certain embodiments of the invention relate to systems and methods for unlocking/locking and opening/closing windows without excessive force and twisting. More specifically, certain embodiments provide a lever mechanism configured to unlock and open an operable vent sash by pivoting approximately one hundred and eighty (180) degrees in a first radial direction on a single plane, and configured to lock and close the operable vent sash by pivoting approximately one hundred and eighty (180) degrees in a second radial direction on the single plane. The force required to pivot the lever mechanism for any operation does not exceed five (5) pounds (lbs.).

BACKGROUND OF THE INVENTION

The Americans with Disabilities Act (ADA), which affects many public and private commercial buildings, is intended to ensure equal access to all persons regardless of physical disabilities. Section 309.4 of the ADA accessibility guidelines related to window and door hardware sets forth that "[o]perable parts shall be operable with one hand and shall not require tight grasping, pinching, or twisting of the wrist. The force required to activate operable parts shall be 5 pounds (22.2 N) maximum." The Department of Justice Standards for Accessible Design (4.27.4) and the International Building Code (ANSI 309.4) set forth similar guidelines.

Architects prefer larger vents for exterior window designs to meet fresh air ventilation requirements. Using a larger quantity of smaller vents is typically more expensive than using a fewer quantity of larger vents. Additionally, current energy codes and specifications require low thermal insulating values for windows. Insulated glass has a better insulating value than metal, so the more metal used in a window system, the lower the insulating value. Because the exterior seal of a vent is subject to lower insulating values by nature and is a weak thermal point in the window system, a larger vent size helps to offset the overall insulating value due to the greater percentage of glass. A larger vent helps in the insulating performance but a larger vent takes more force to open.

Although using larger vents may improve insulating performance and decrease costs for architects, larger vents are typically more difficult to open and close. More specifically, an insulated glass unit weighs approximately seven (7) lbs. per square foot and can weigh as much as eight and one half (8.5) lbs. per square foot for insulated laminated glass. When aluminum and other materials are added to construct the vent frame and sash, a vent can weigh around nine (9) lbs. per square foot or more. As such, a four (4) foot by five (5) foot vent may weigh approximately one hundred and eighty-nine (189) lbs. or more, which may be difficult to open using not more than five (5) lbs. of operational force as required by applicable ADA and other guidelines.

In addition to generally being more difficult to open and close, larger vents are also typically more difficult to lock and unlock. Vents, like other window systems, are manufactured and installed to meet strict air and water performance specifications. As such, to compress a sash to a vent frame of the window system, a great deal of compressive force can be needed to make the system air and water tight. The compression of the sash to the vent frame is commonly achieved by the locking of the sash using the vent handle, which moves one or more transmission bars inside a euro-grove (or vent track) around the perimeter of the sash when the vent handle is rotated in one direction.

For example, FIGS. 19A and 19B are diagrams that illustrate an exemplary awning vent 100 with an exemplary locking mechanism as is known in the art. Referring to FIG. 19B, the exemplary locking mechanism of the exemplary awning vent 100 may comprise, as an example, a handle 101, handle connectors 102, main transmission bars 103, transmission device connectors 104, 105, 110, corner transmission device housings 106, keepers 107, locking points 108, side transmission bars 109, and friction hinges 111. The handle 101 can attach to an inner portion of the sash. Certain components on an underside of the handle 101 may extend through the sash to an outer portion of the sash.

The handle connectors 102 may couple to the underside of the handle 101 at the outer portion of the sash and slidably fit in a euro-grove (not shown) that extends around an outer perimeter of the sash. Transmission bars 103 can attach to the handle connectors 102 at one end and corner transmission device connectors 104 at the other end, and may slidably fit in the euro-grove. The corner transmission device connectors 104 may slidably fit into corner transmission device housings 106. An outward, horizontal force on corner transmission device connectors 104 may cause the corner transmission device connectors 104 to extend into the corner transmission device housings 106, which in turn may cause the corner transmission device connectors 105 to extend vertically in the exemplary awning vent illustrated in FIG. 19B.

Referring still to FIG. 19B, side transmission bars 109 may attach to the corner transmission device connectors 105 at one end and transmission device connectors 110 at the other end, and may slidably fit in the euro-grove. Friction hinges 111 can attach to the sash and vent frame on both sides of the exemplary awning vent 100 and may be operable to guide and support the sash when venting as well as limit the opening range of the sash.

Locking points 108 may be attached to, or integrated with, one or more transmission bars 103, 109, or other components of the vent locking mechanism such as the transmission device connectors 104, 105, and 110, and may engage (or mate) with keepers 107, positioned at corresponding points on the vent frame, when moved by the handle 101 to the locking position. The engaging of the locking points 108 with the keepers 107 results in compression of the sash to the vent frame to make a tight seal. The larger the vent 100, the more locking points 108 and keepers 107 are needed to achieve an adequate seal. Further, the more locking points 108 and keepers 107, the more force is needed to lock and unlock the vent.

Many current vent designs for exterior windows require in excess of five (5) lbs. of force to open/close a sash. For example, many current vent designs do not use any mechanisms to open/close a sash (e.g., push open and pull closed), which may require more than five (5) lbs. of force, particularly for larger vents. Further, current vent designs that do have mechanisms for opening/closing a sash may not alleviate the force necessary to open/close the sash to meet the ADA guidelines. Instead, some mechanisms, such as cranks, not only may require more force to open, but also require excessive twisting. Additionally, many current vent designs for exterior windows require in excess of five (5) lbs. of force to lock/unlock a sash, particularly for larger vents having locking mechanisms with more locking points. Also, many current vent designs that do have mechanisms for opening/closing a sash use different mechanisms to unlock/lock a sash. Further, several existing vent designs require separate, independent movements in different planes to unlock/lock and/or open/close a sash.

As such, there is a need for providing systems and methods for unlocking/locking and opening/closing windows without excessive force and twisting by combining operations (e.g., unlocking and opening, or locking and closing) into a single fluid movement in a single plane (i.e., a single axis movement) using a single mechanism.

Further limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE INVENTION

Systems and methods for unlocking/locking and opening/closing windows without excessive force and twisting is provided, substantially as shown in and/or described in connection with at least one of the figures, as set forth more completely in the claims.

These and other advantages, aspects and novel features of the present invention, as well as details of an illustrated embodiment thereof, will be more fully understood from the following description and drawings.

Figure 1:
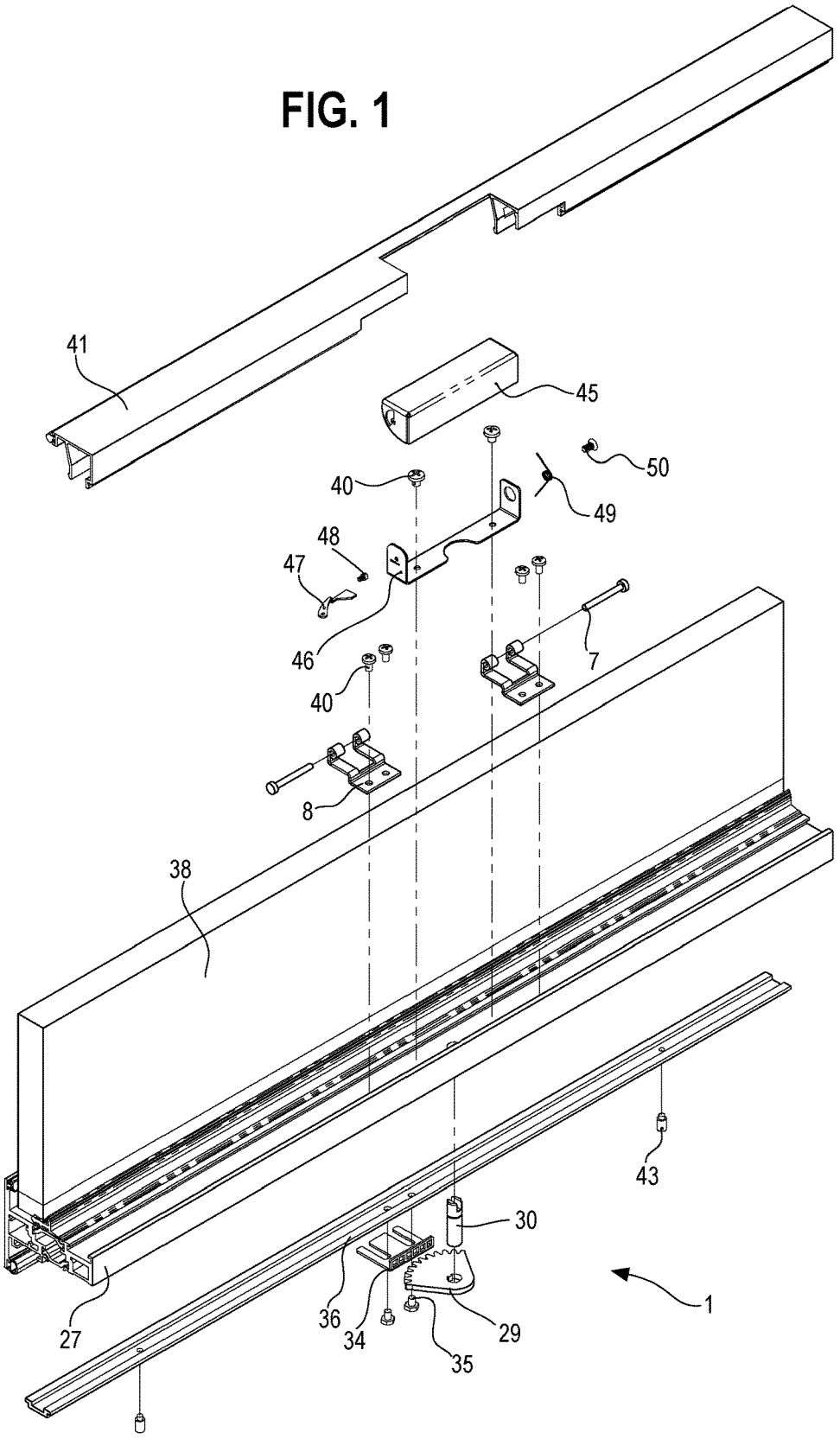
FIG. 1 is a diagram that illustrates an exploded perspective view of a vent sash having exemplary connections configured to interface with a lever mechanism in accordance with an embodiment of the present invention.

The foregoing summary, as well as the following detailed description of certain embodiments of the present invention, may be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION

Certain embodiments of the invention may be found in systems and methods for unlocking/locking and opening/ closing windows without excessive force and twisting. More specifically, certain embodiments provide a lever mechanism 1 configured to unlock and open an operable vent sash 27 by pivoting substantially one hundred and eighty (180) degrees in a first radial direction on a single plane, and configured to lock and close the operable vent sash 27 by pivoting substantially one hundred and eighty (180) degrees in a second radial direction on the single plane. The force required to pivot the lever mechanism 1 for any operation does not exceed five (5) pounds (lbs.).

Various embodiments provide a lever mechanism system 1 for unlocking, opening, closing and locking a vent sash 27. The lever mechanism system 1 may comprise push arms 5, drive arms 3, 4, gears 11, 12, a locking gear slide 20, and a handle 10. Each of the push arms 5 comprises a first push arm end and a second push arm end. Each of the push arms 5 pivotably couples to the vent sash 27 at the second push arm end. Each of the drive arms 3, 4 comprises a first drive arm end and a second drive arm end. Each of the drive arms 3, 4 pivotably couples at the second drive arm end to the first push arm end of a corresponding one of the push arms. Each of the gears 11, 12 is coupled to the first drive arm end of a corresponding one of the drive arms 3, 4. The locking gear slide 20 is operable to interface with a locking mechanism of the vent sash 27. The handle 10 is operable to radially rotate approximately one hundred eighty degrees in a first direction on a single plane to pivot the locking gear slide 20 to move the locking mechanism of the vent sash 27 to an unlocked position, and rotate the gears 11, 12 to extend the drive arms 3, 4, and the push arms 5 such that the vent sash 27 is pushed to an open position. The handle 10 is operable to radially rotate approximately one hundred eighty degrees in a second direction on the single plane to rotate the gears 11, 12 to retract the drive arms 3, 4 and the push arms 5 such that the vent sash 27 is pulled to a closed position, and pivot the locking gear slide 20 to move the locking mechanism of the vent sash 27 to a locked position.

As used herein, the terms "exemplary" or "example" means serving as a non-limiting example, instance, or illustration. As used herein, the term "e.g." introduces a list of one or more non-limiting examples, instances, or illustrations.

As used herein, an element recited in the singular and proceeded with the word "a" or "an" should be understood as not excluding plural of the elements, unless such exclusion is explicitly stated. Furthermore, references to "an embodiment," "one embodiment," "a representative embodiment," "an exemplary embodiment," "various embodiments," "certain embodiments," and the like are not intended to be interpreted as excluding the existence of additional embodiments that also incorporate the recited features. Moreover, unless explicitly stated to the contrary, embodiments "comprising," "including," or "having" an element or a plurality of elements having a particular property may include additional elements not having that property.

Figure 19A:
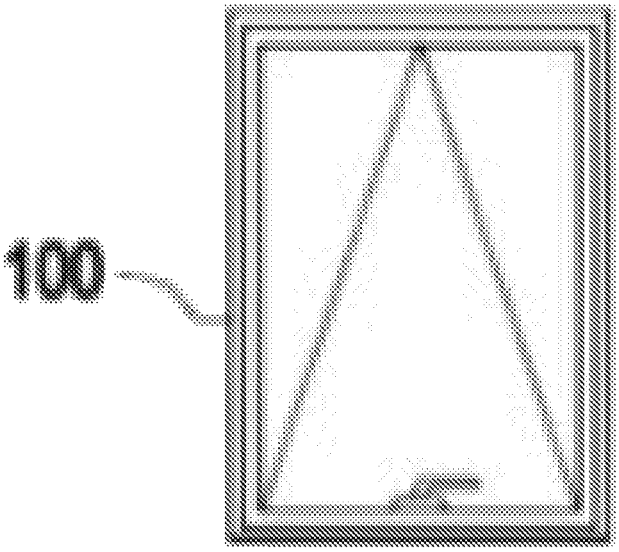
FIGS. 19A and 19B are diagrams that illustrate an exemplary awning vent with an exemplary locking mechanism as is known in the art.
Figure 19B:
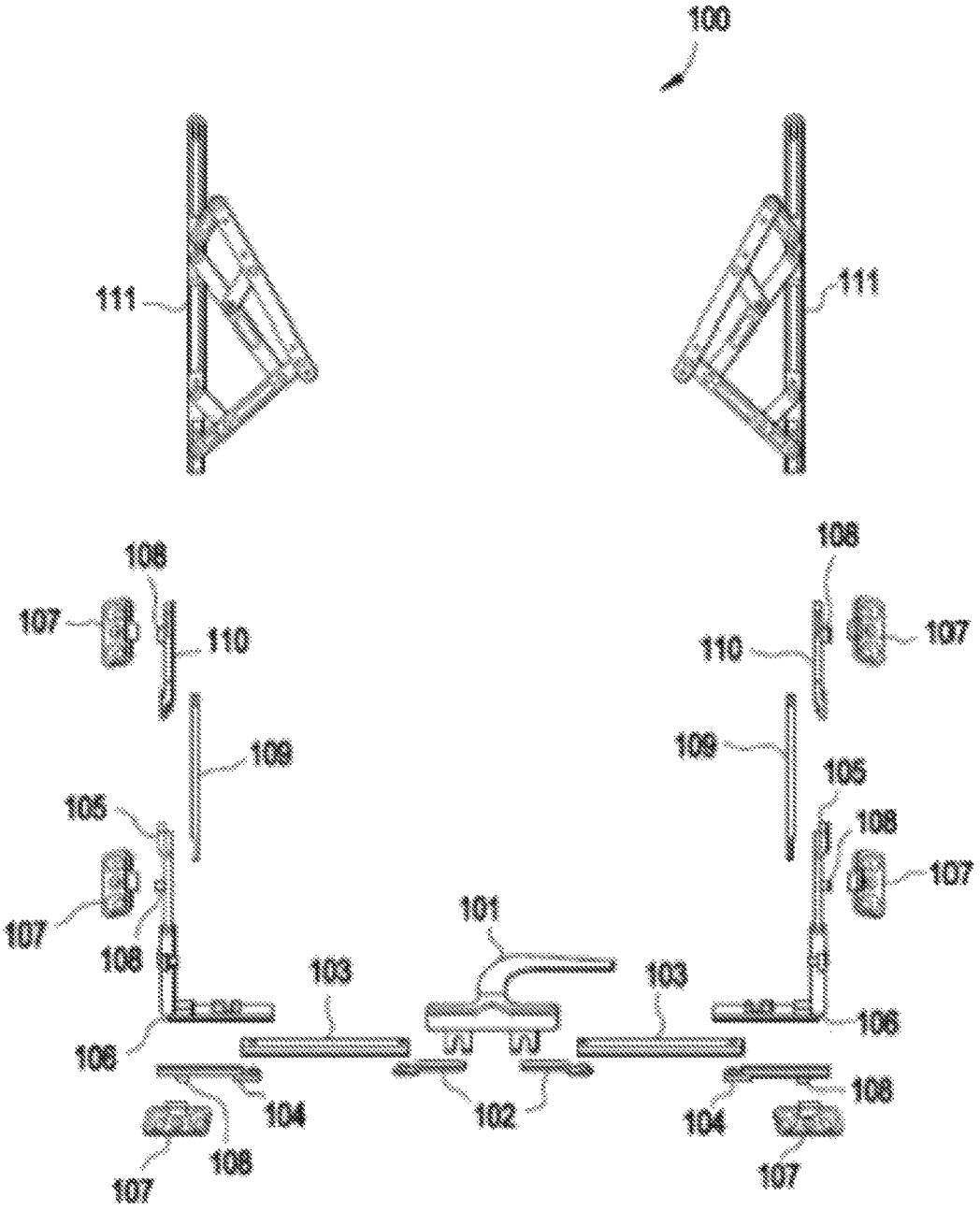

Although certain embodiments in the foregoing description may be described in reference to awning vents, unless so claimed, the scope of various aspects of the present invention should not be limited to awning vents and may additionally and/or alternatively be applicable to casement vents, hopper vents, or any suitable vent. Further, although the viewpoint of FIGS. 1-17 may appear as though the lever mechanism 1 is attached at a base of a window frame 26 and vent sash 27, the scope of various aspects of the present invention should not be limited to the viewpoint of the handle 10 and/or lever mechanism 1 being positioned at a base of a window frame 26 and vent sash 27 and may additionally and/or alternatively be a viewpoint of the handle 10 and/or lever mechanism 1 being positioned at any side and position along the perimeter of the window frame 26 and vent sash 27. Additionally, although certain embodiments in the foregoing description may describe the lever mechanism as interacting with a euro-grove/transmission bar locking system as illustrated in FIG. 19, for example, unless so claimed, the scope of various aspects of the present invention should not be limited to euro-grove/transmission bar locking systems and may additionally and/or alternatively be applicable to any suitable vent locking system.

As used in the present application, the term "approximately 45 degrees" refers to a range of between 30 and 60 degrees of handle 10 rotation. The term "approximately 135 degrees" refers to a range between 120 and 150 degrees of handle 10 rotation. The term "approximately 180 degrees" refers to a range between 170 and 190 degrees of handle 10 rotation. The sum of the "approximately 45 degrees" and the "approximately 135 degrees" equals the "approximately 180 degrees."

FIG. 1 is a diagram that illustrates an exploded perspective view of a vent sash 27 having exemplary connections 7, 8, 30 configured to interface with a lever mechanism 1 in accordance with an embodiment of the present invention. Referring to FIG. 1, a vent sash 27 comprises glass, or any suitable infill 38, a locking mechanism, and connections configured to interface with a lever mechanism 1. The connections may include a hinge bottom 8 connected to a hinge top 6 (shown in FIGS. 2, 3, 8, and 13) by a pin 7 and a locking spindle 30 that interfaces with the lever mechanism 1 to lock and unlock the vent sash 27. For example, the locking spindle 30 may comprise a groove for receiving a protrusion of a locking gear slide 20 (shown in FIG. 2). The locking gear slide 20 may rotate the locking spindle 30 to control the locking mechanism.

The locking mechanism may comprise, for example, a transmission bar 36, locking points 43, rack 34, and rack gear 29. The locking points 43 may be attached to, or integrated with, the transmission bar 36 and are configured to disengagably coupling to corresponding keepers 42 (shown in FIGS. 2, 8, 9, 13, and 14) to secure and seal the vent sash 27. The transmission bar 36 can be coupled to a rack 34 by mounting screws 35. The rack 34 is configured to mate with a rack gear 29 that is rotated with the rotation of a connected locking spindle. In operation, rotation of the locking spindle 30 by the lever mechanism 1 rotates the rack gear 29 to slide the rack 34 and connected transmission bar 36 such that the locking points 43 slide in and out of the keepers 42 to lock and unlock the vent sash 27. Although FIG. 1 and the above-description, for example, describe a particular transmission bar locking system, unless so claimed, the scope of various aspects of the present invention should not be limited to the particular transmission bar locking system and may additionally and/or alternatively be applicable to any suitable vent locking system configured to interface with the lever mechanism 1.

Still referring to FIG. 1, certain embodiments of the vent sash 27 include a glazing bead 41 that holds the glass or any suitable infill 38 in place. The glazing bead 41 may comprise a flip cover 45 for providing a clean finish by hiding the locking spindle 30 when the vent sash 27 is in an open position. In various embodiments, the flip cover 45 is pivotably mounted to a flip cover frame 46 by screws 48, 50. The frame 46 is mounted to the vent sash 27 by, for example, mounting screws 40 or any suitable attachment mechanism. A torsion spring 49 biases the flip cover 45 in a closed position. A flip cover rotation mechanism 47, 51 may force the flip cover 45 to an open position as the vent sash 27 is moved to a closed position by the lever mechanism 1 as described below in connection with FIGS. 8 and 13.

Figure 2:
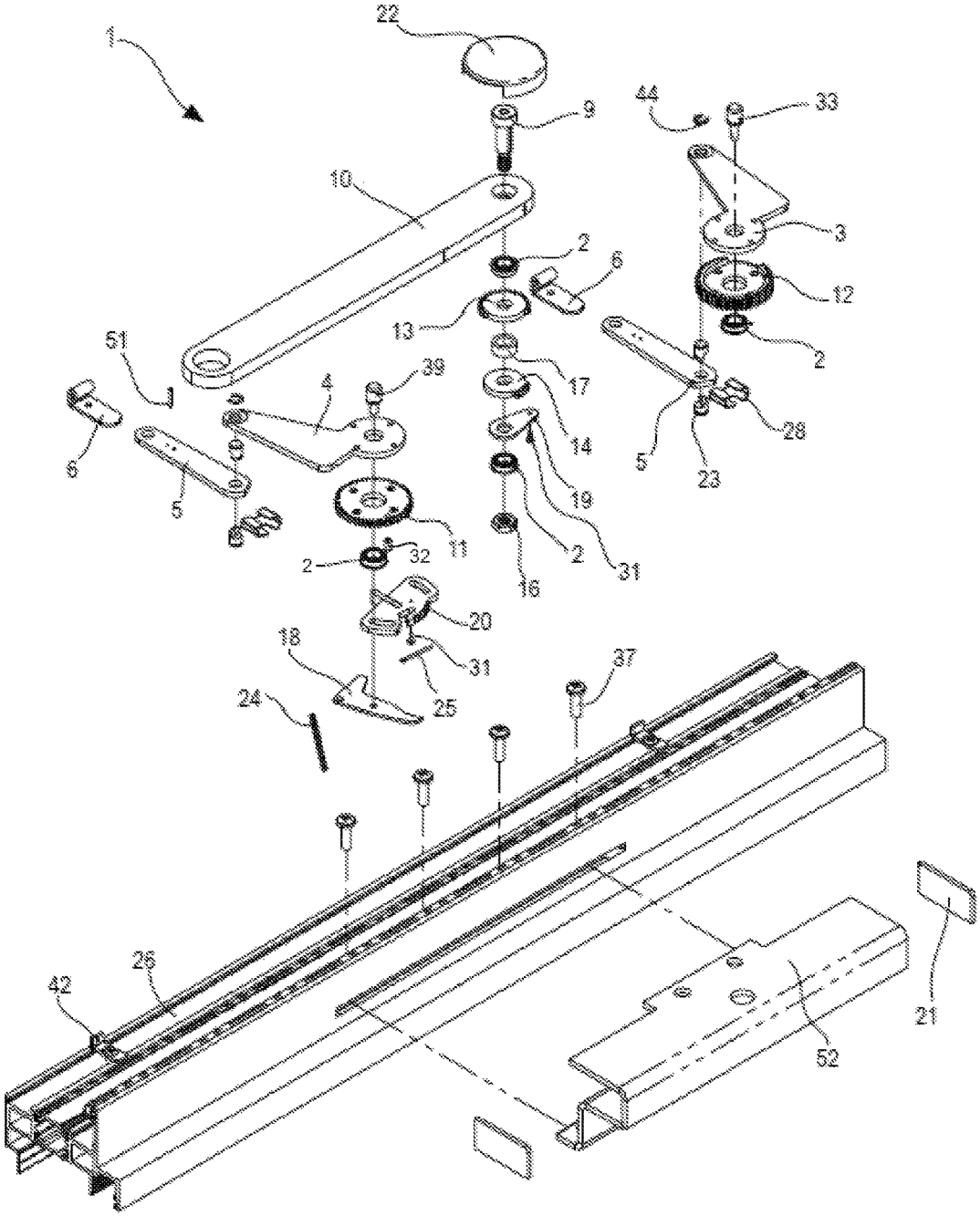
FIG. 2 is a diagram that illustrates an exploded perspective view of an exemplary lever mechanism configured to mount to a window frame and interface with the vent sash of FIG. 1 in accordance with an embodiment of the present invention.

FIG. 2 is a diagram that illustrates an exploded perspective view of an exemplary lever mechanism 1 configured to mount to a window frame 26 and interface with the vent sash 27 of FIG. 1 in accordance with an embodiment of the present invention. Referring to FIG. 2, the lever mechanism 1 comprises a handle 10, gears 11-14, locking hook 18, locking arm 19, locking gear slide 20, drive arms 3, 4, push arms 5, and frame 52. The frame 52 houses and protects components of the lever mechanism 1 while providing an aesthetically-pleasing clean finish. The lever mechanism frame 52 may be mounted to a window frame 26 by mounting screws 37 and comprises an aperture providing access for the handle 10 to couple with the other lever mechanism 1 components housed within the frame 52. The frame can include caps 21 for covering sides of the frame 52.

The handle 10 may be telescopic and/or otherwise collapsible, foldable, or the like. In various embodiments and as discussed in more detail below, the handle 10 may be grasped and rotated or pivoted to unlock and open, or lock and close, the vent sash 27. The force required to pivot the handle 10 for any operation does not exceed five (5) pounds (lbs.). The handle 10 rotates or pivots a shoulder screw 9 that couples the handle 10 at its pivot point to the components of the lever mechanism 1 housed in the frame 52 via the aperture in the frame 52. A cap 22 may be attached to the handle 10 over the shoulder screw 9 to provide a clean finish and prevent the shoulder screw from snagging passerby. The shoulder screw 9 may extend through and rotate a drive gear 13, cam gear 14, and locking arm 19. The gears 13, 14 and locking arm 19 can be held on the shoulder screw 9 with a nut 16. Roller bearings 2 and spacers 17 can also be held on the shoulder screw between the gears 13, 14 and locking arm 19 to properly position and reduce friction between the gears 13, 14 and locking arm 19.

Still referring to FIG. 2, as the handle 10 and shoulder screw 9 are rotated, the drive gear 13 rotates to mate with and drive the gear 12. As explained below, the gear 12 may operate with other components of the lever mechanism 1 to open and close a vent sash 27. The drive gear 13 may be configured such that it engages the gear 12 after the first approximately 45 degrees of an approximately 180 degree rotation of the handle 10 and shoulder screw 9. For example, when the vent sash is in a locked/closed position, the handle 10 and shoulder screw 9 may be rotated such that the first approximately 45 degrees of rotation may unlock the vent sash 27 and the next approximately 135 degrees of rotation may open the vent sash 27 using the gear 12 and other components of the lever mechanism 1. Conversely, when the vent sash is in an unlocked/open position, the handle 10 and shoulder screw 9 may be rotated in an opposite direction such that the first approximately 135 degrees of rotation closes the vent sash 27 using the gear 12 and other components of the lever mechanism 1 and the next approximately 45 degrees of rotation locks the vent sash 27. The drive gear 13 can be configured to engage the gear 12 at pre-determined handle 10 positions by, for example, configuring the placement of teeth of the drive gear 13 that mesh with teeth of the gear 12.

The gear 12 may be integrated with a first end of a drive arm 3 and/or coupled to the first end of the drive arm 3 with a pin 33 that extends through the gear 12 and drive arm 3 and mates with a slot of the locking gear slide 20. One or more roller bearings 2 can also be placed on the pin 33 to reduce friction, such as between the gear 12 and the locking gear slide 20. The second end of the drive arm 3 pivotably couples to a first end of a push arm 5 by a hinged pin 23. The hinged pin 23 allows for the drive arm 3 and push arm 5 to pivot with respect to each other in a horizontal plane as the combination of the drive arm 3 and push arm 5 extend to push open the vent sash 27 or retract to pull close the vent sash 27. The hinged pin 23 may also allow the push arm 5 to pivot in a vertical plane with respect to the stationary drive arm 3 to accommodate the change in vertical plane created by the vent sash 27 swinging out to open or in to close. The horizontal and vertical planes described above assume an embodiment where the lever mechanism 1 is attached at a base or top of a window frame 26 and vent sash 27. The lever mechanism 1 can alternatively be positioned at the sides of the window frame 26 and vent sash 27 as disclosed above.

The gear 12, which is aligned with and driven by drive gear 13, may also mate with and drive gear 11. For example, the gear 12 may have a thickness that allows its teeth to engage teeth of both gear 11 and drive gear 13. The gear 11 may be integrated with a first end of a drive arm 4 and/or coupled to the first end of the drive arm 4 with a pin 39 that extends through the gear 11, drive arm 4, a slot of the locking gear slide 20, and into locking hook 18. The gear 11 includes a pin 32 that extends toward the locking gear slide 20 and is configured to slidably engage a central open slot of the gear slide 20 to prevent rotation of the gear 11 during the first 45 degrees when opening the vent sash 27 and during the last 45 degrees with closing the vent sash 27.

The gear 11 and drive arm 4 are integrated or attached such that they rotate in unison when the gear 11 is driven by the gear 12. The gear slide 20 and locking hook 18 independently rotate on the pin 39. In an exemplary embodiment, one or more roller bearings 2 can be placed on the pin 39 to reduce friction, such as between the gear 11 and the locking gear slide 20. The second end of the drive arm 4 pivotably couples to a first end of a second push arm 5 by a second hinged pin 23. The hinged pin 23 allows for the drive arm 4 and push arm 5 to pivot with respect to each other in one or more of horizontal and vertical planes as the combination of the drive arm 3 and push arm 5 extend to push open the vent sash 27 or retract to pull close the vent sash 27.

Various embodiments provide retaining rings 44 and/or quick release locks 28 that may hold the hinged pins 23 in place. The quick release locks 28 can be configured to be pulled away from each of the hinged pins 23 such that the push arms 5 can be released from the drive arms 3, 4. The second ends of the push arms 5 can be integrated with or attached to hinge tops 6 that pivotably attach to the hinge bottoms 8 via the pins 7 of FIG. 1. The hinge mechanisms 6-8 allow the vent sash 27 to pivot with respect to the push arms 5 while the vent sash 27 swings out to open or in to close.

The locking gear slide 20 comprises a protrusion, gear teeth, a locking gear spring 25, slots at each end, and a central open slot. The protrusion of the gear slide 20 engages the locking spindle 30 of FIG. 1 to lock and unlock the vent sash 27. The locking gear spring 25 biases the locking gear slide 20 in an unlocked position. The end slots of gear slide 20 receive pins 33, 39 to limit the range of rotation of the locking gear slide 20. The central open slot of gear slide 20 is configured to slidably receive the pin 32 that extends from the gear 11 to prevent rotation of the gear 11 during the first approximately 45 degrees of a first approximately 180 degree handle 10 rotation when unlocking the vent sash 27 and during the last approximately 45 degrees of a second approximately 180 degree handle 10 rotation when locking the vent sash 27. The gear teeth of the locking gear slide 20 are configured to engage with teeth of the cam gear 14. The teeth of the cam gear 14 are configured to engage with the teeth of the locking gear slide 20 during the first approximately 45 degrees of handle 10 rotation in a first direction when unlocking the vent sash 27 and during the last approximately 45 degrees of handle 10 rotation in a second direction, opposite the first direction, when locking the vent sash 27. The cam gear 14 can be configured to engage the teeth of the locking gear slide 20 at pre-determined handle 10 position ranges by, for example, configuring the placement of teeth of the cam gear 14 that mate with the teeth of the locking gear slide 20.

The locking arm 19 comprises a locking pin 31 and is configured to rotate in unison with the handle 10 and shoulder screw 9. The locking pin 31 is configured to catch and pivot the locking hook 18 to a closed position as the locking arm 19 rotates during the last approximately 45 degrees of an approximately 180 degree handle 10 rotation when locking the vent sash 27. Conversely, the locking pin 31 is configured to release the looking hook 18 as the locking arm 19 rotates during the first approximately 45 degrees of an approximately 180 degree handle 10 rotation when unlocking the vent sash 27. The locking hook 18 is biased in an open position by spring 24 such that the locking hook 18 is in an open position when not engaged with the locking pin 31 of the locking arm 19. The purpose of the locking hook 18 is to wrap behind the locking spindle 30 of the vent sash 27 shown in FIG. 1 to seal the vent sash in a closed position.

Figure 3:
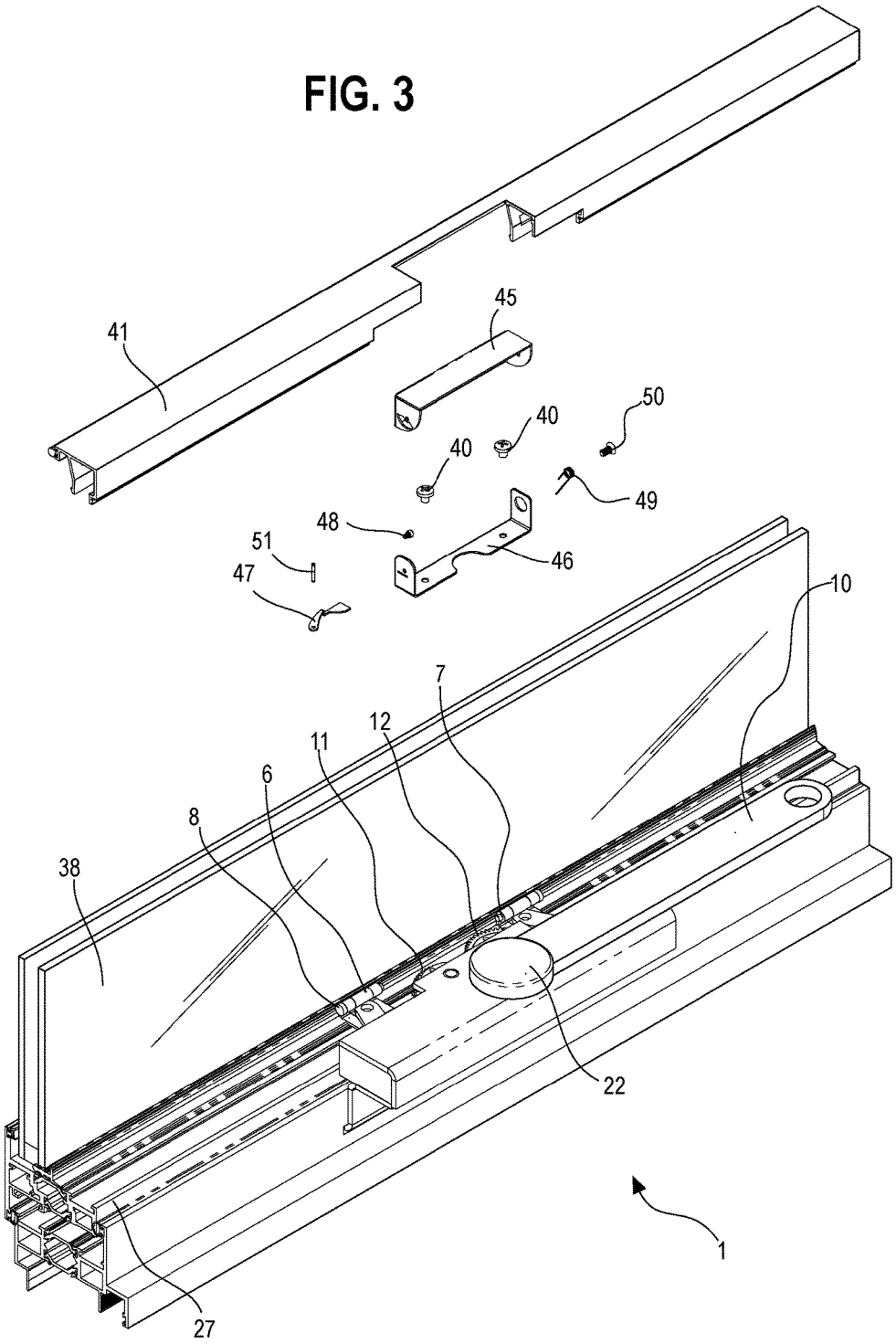
FIG. 3 is a diagram that illustrates an exploded perspective view of an exemplary lever mechanism in a locked/closed position in accordance with an embodiment of the present invention.
Figure 8:
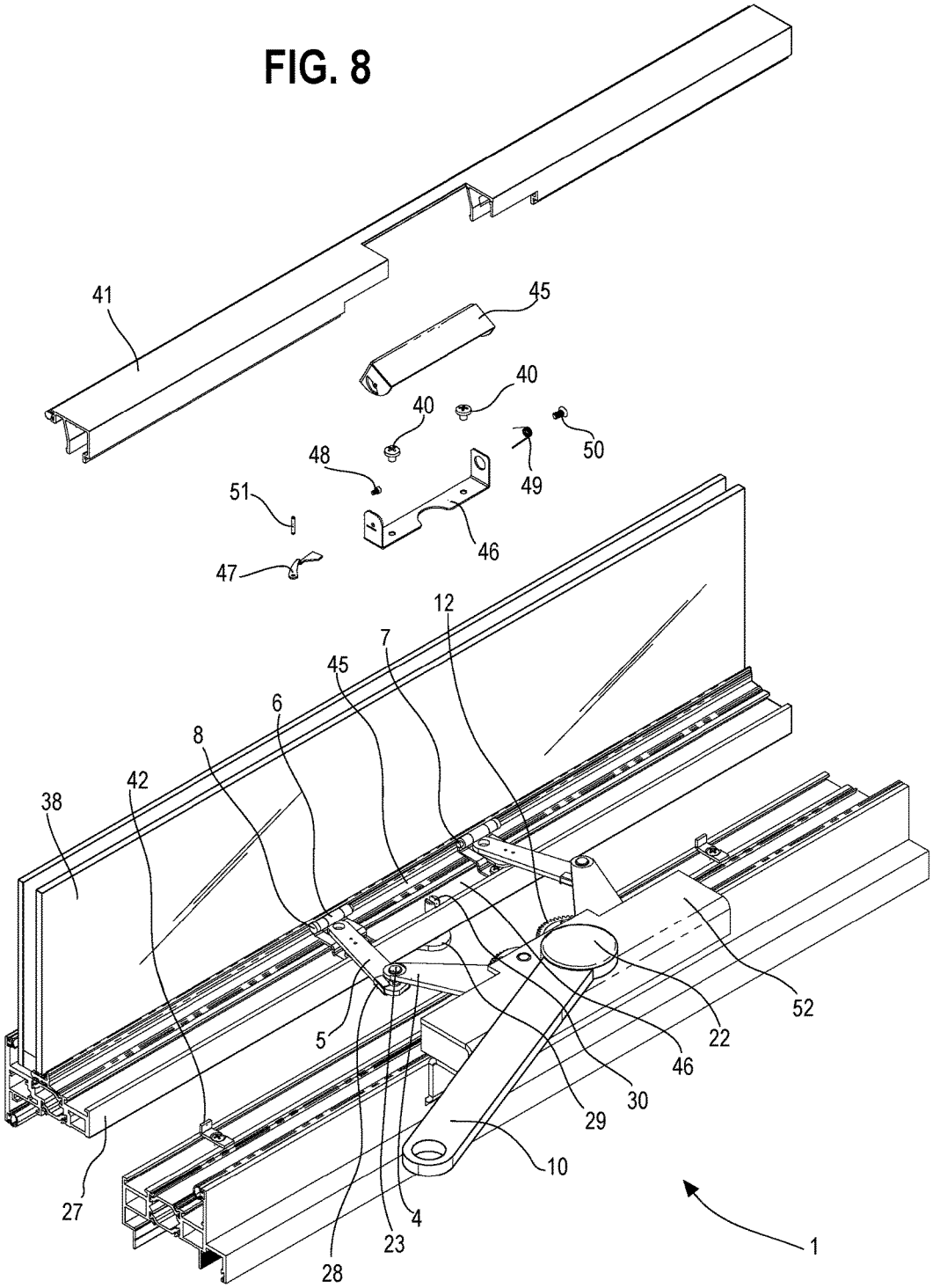
FIG. 8 is a diagram that illustrates an exploded perspective view of an unlocked exemplary lever mechanism being moved to an open position in accordance with an embodiment of the present invention.
Figure 13:
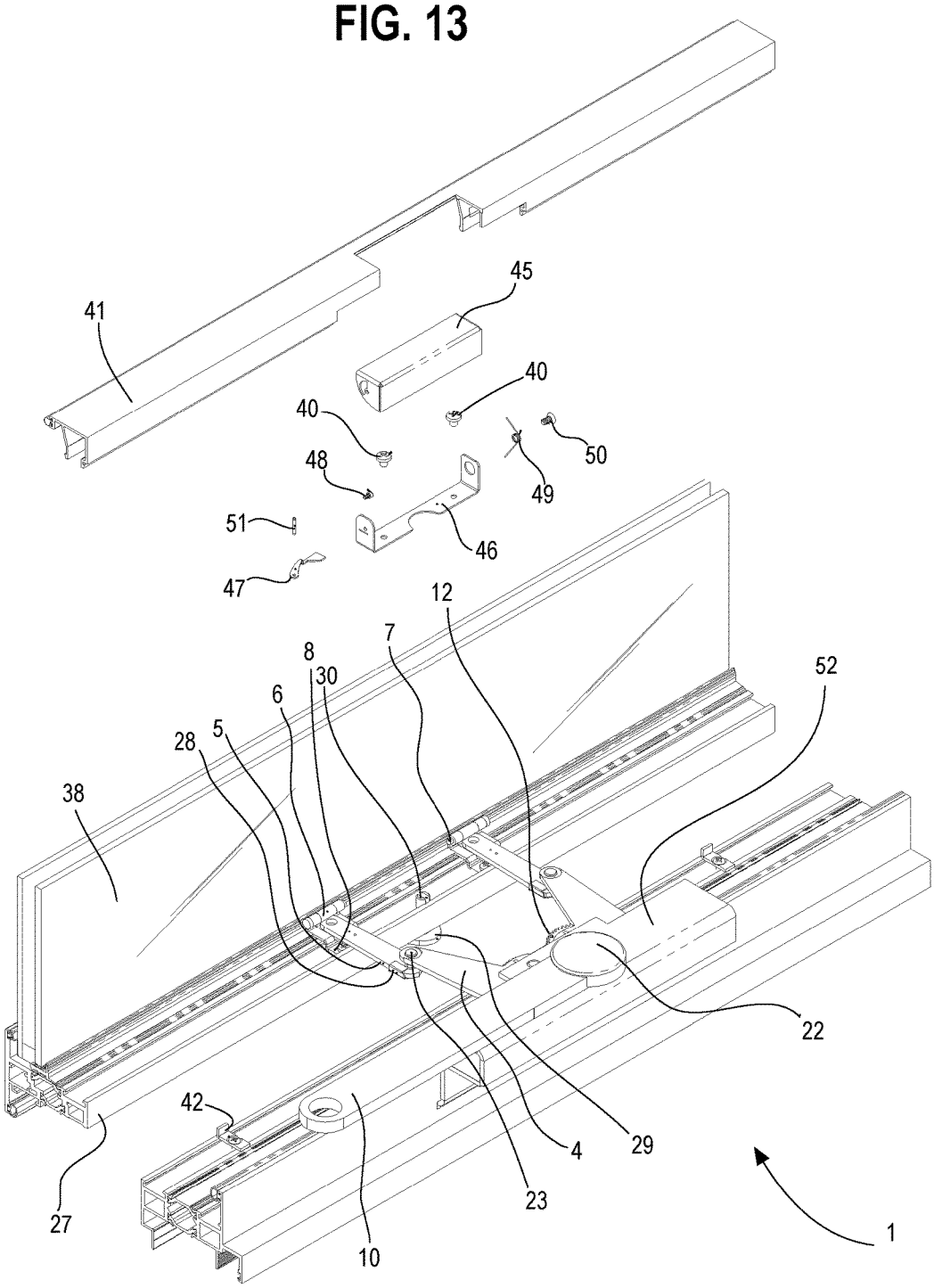
FIG. 13 is a diagram that illustrates an exploded perspective view of an exemplary lever mechanism in an unlocked/open position in accordance with an embodiment of the present invention.

FIG. 3 is a diagram that illustrates an exploded perspective view of an exemplary lever mechanism 1 in a locked/closed position in accordance with an embodiment of the present invention. FIG. 8 is a diagram that illustrates an exploded perspective view of an unlocked exemplary lever mechanism 1 being moved to an open position in accordance with an embodiment of the present invention. FIG. 13 is a diagram that illustrates an exploded perspective view of an exemplary lever mechanism 1 in an unlocked/open position in accordance with an embodiment of the present invention. Referring to FIGS. 3, 8, and 13, there is shown a lever mechanism 1 and a vent sash 27.

The vent sash 27 comprises infill 38, glazing beading 41, and a locking mechanism. The locking mechanism can include a rack gear 29, locking spindle 30, and keepers 42, among other things, as described above with respect to FIGS. 1-2. The infill 38 may be glass, aluminum, stone, wood, or any suitable material. The infill 38 may be held in place by glazing beading 41. The glazing beading 41 can include a flip cover 45 for allowing access to a locking spindle 30 when the vent sash 27 is closed and to provide a clean finish by hiding the locking spindle 30 when the vent sash 27 is open. The ends of the flip cover 45 may be pivotably attached to ends of a flip cover frame 46 by screws 48, 50. The flip cover frame 46 can be mounted to the vent sash 27 by mounting screws 40 or any suitable attachment mechanism. The flip cover 45 may be biased in a closed position by a torsion spring 49. The flip cover 45 can be forced open by a flip cover rotation mechanism. The flip cover rotation mechanism may be bevel gears, a key 47 and key shaft 51, or any suitable mechanism for rotating the flip cover 45 to an open position. As illustrated in FIGS. 3, 8, and 13, a key 47 is configured to extend into an aperture in the flip cover 45 and be attached to a push arm 5 by a key shaft 51. As the push arm 5 is pivoted to pull the vent sash 27 closed, the key 47 may be partially pulled out of the flip cover 45 aperture to force the flip cover 45 open.

Still referring to FIGS. 3, 8, and 13, the lever mechanism 1 comprises a frame 52, drive arms, 3, 4, push arms 5, a hinge mechanism 6-8, gears 11, 12, and a handle 10. The hinge mechanism 6-8 couples the lever mechanism 1 to the vent sash 27 and includes a hinge bottom 8, hinge top 6, and a pin 7 coupling the hinge bottom 8 to the hinge top 6. The hinge bottom 8 can be coupled to the vent sash 27 and the hinge top 6 may be coupled to push arms 5 of the lever mechanism 1. The gears 11, 12 can be configured to drive arms 3-5 to push a vent sash 27 open or pull it closed. The drive arms 3, 4 may be pivotably attached to push arms 5 by hinged pins 23. In various embodiments, quick release locks 28 may be provided to provide a mechanism for releasing the push arms 5 from the drive arms 3, 4. The handle 10 is rotated in a first direction to drive the components of the lever mechanism 1 to unlock and open the vent sash 27. The handle 10 is rotated in a second direction, opposite the first direction, to close and lock the vent sash 27. The handle 10 can include a cap 22 to provide a clean finish by hiding the connection between the handle 10 and the other components of the lever mechanism 1, such as a shoulder screw 9, for example. The frame 52 houses and protects components of the lever mechanism 1 while providing an aesthetically-pleasing clean finish.

As illustrated in FIG. 3, the handle 10 is in an exemplary position where the vent sash 27 is locked and closed. As illustrated in FIG. 8, the handle 10 is in an exemplary position where the vent sash 27 is unlocked and in the process of being opened. As illustrated in FIG. 13, the handle 10 is in an exemplary position where the vent sash 27 is unlocked and fully open. The lever mechanism 1 illustrated in FIGS. 3, 8, and 13 shares various characteristics with the lever mechanism 1 illustrated in FIGS. 1-2 as described above.

Figure 4:
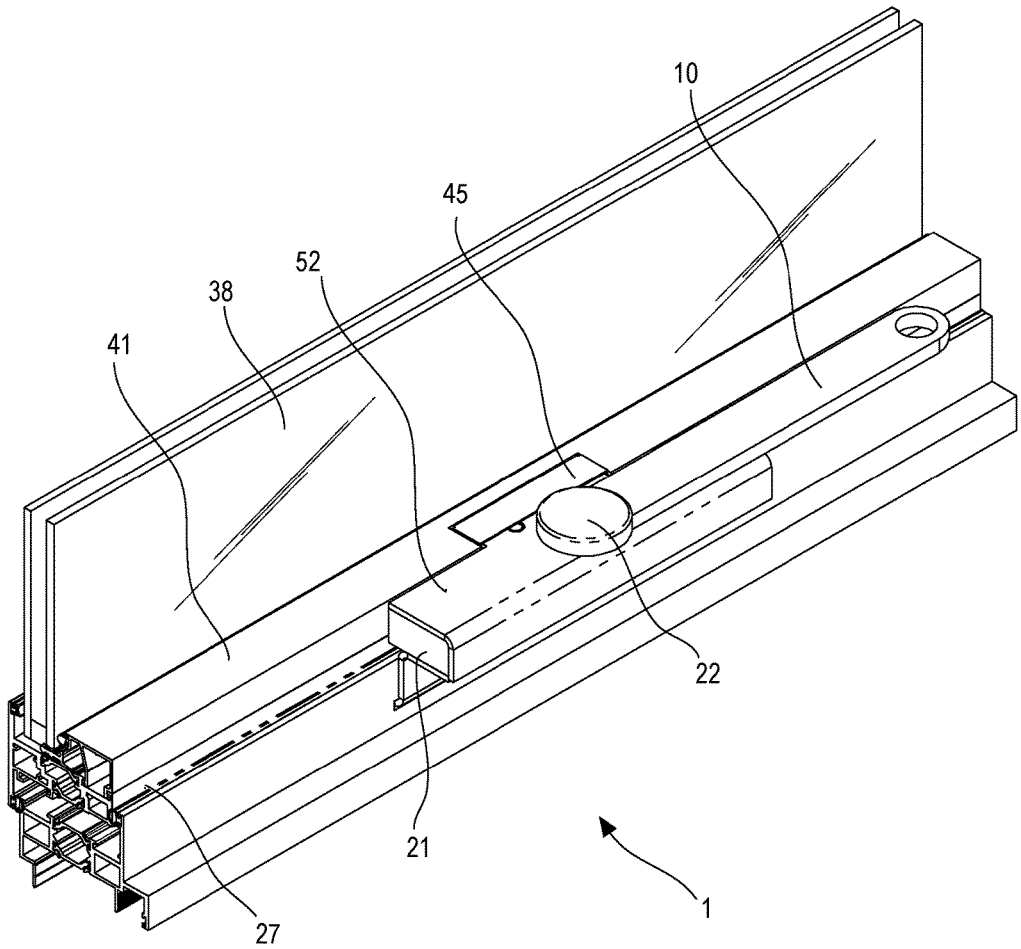
FIG. 4 is a diagram that illustrates a front perspective view of an exemplary lever mechanism in a locked/closed position in accordance with an embodiment of the present invention.
Figure 9:
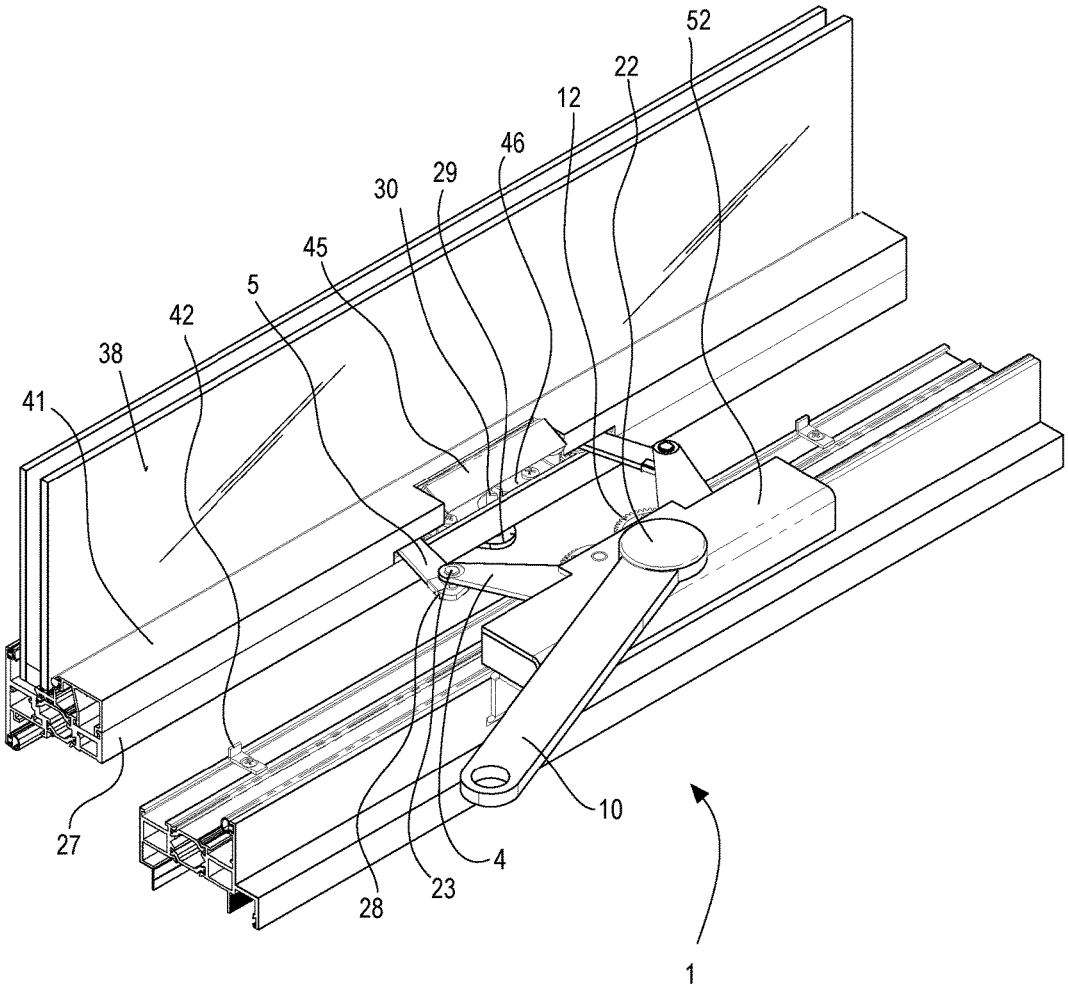
FIG. 9 is a diagram that illustrates a front perspective view of an unlocked exemplary lever mechanism being moved to an open position in accordance with an embodiment of the present invention.
Figure 14:
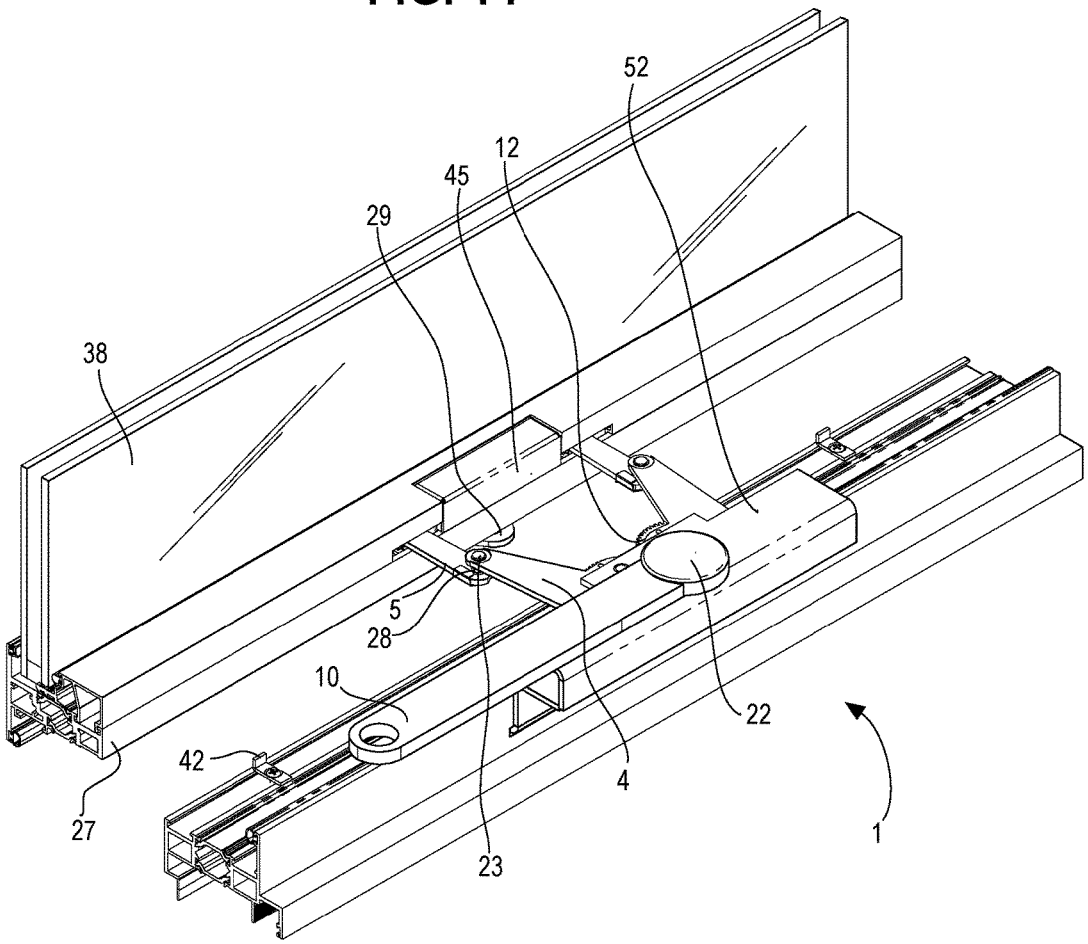
FIG. 14 is a diagram that illustrates a front perspective view of an exemplary lever mechanism in an unlocked/open position in accordance with an embodiment of the present invention.

FIG. 4 is a diagram that illustrates a front perspective view of an exemplary lever mechanism in a locked/closed position in accordance with an embodiment of the present invention. FIG. 9 is a diagram that illustrates a front perspective view of an unlocked exemplary lever mechanism being moved to an open position in accordance with an embodiment of the present invention. FIG. 14 is a diagram that illustrates a front perspective view of an exemplary lever mechanism in an unlocked/open position in accordance with an embodiment of the present invention. Referring to FIGS. 4, 9, and 14, there is shown a lever mechanism 1 and a vent sash 27.

The vent sash 27 comprises infill 38, glazing beading 41, and a locking mechanism. The locking mechanism can include a rack gear 29, locking spindle 30, and keepers 42, among other things, as described above with respect to FIGS. 1-2. The glazing beading 41 can include a flip cover 45 for allowing access to a locking spindle 30 when the vent sash 27 is closed and to provide a clean finish by hiding the locking spindle 30 when the vent sash 27 is open. The flip cover 45 may comprise a flip cover frame 46, a flip cover rotation mechanism, screws 48, 50, torsion spring 49, and mounting screws 40.

The lever mechanism 1 comprises a frame 52, drive arms, 3, 4, push arms 5, a hinge mechanism 6-8, gears 11, 12, and a handle 10. The hinge mechanism 6-8 couples the lever mechanism 1 to the vent sash 27 and includes a hinge bottom 8, hinge top 6, and a pin 7 coupling the hinge bottom 8 to the hinge top 6. The gears 11, 12 can be configured to drive arms 3-5 to push a vent sash 27 open or pull it closed. The drive arms 3, 4 may be pivotably attached to push arms 5 by hinged pins 23. In various embodiments, quick release locks 28 may be provided to provide a mechanism for releasing the push arms 5 from the drive arms 3, 4. The handle 10 can include a cap 22 to provide a clean finish by hiding the connection between the handle 10 and the other components of the lever mechanism 1. The frame 52 houses and protects components of the lever mechanism 1 while providing an aesthetically-pleasing clean finish. The frame 52 may include caps 21 for covering sides of the frame 52.

As illustrated in FIG. 4, the handle 10 is in an exemplary position where the vent sash 27 is locked and closed. As illustrated in FIG. 9, the handle 10 is in an exemplary position where the vent sash 27 is unlocked and in the process of being opened. As illustrated in FIG. 14, the handle 10 is in an exemplary position where the vent sash 27 is unlocked and fully open. The lever mechanism 1 illustrated in FIGS. 4, 9, and 14 shares various characteristics with the lever mechanism 1 illustrated in FIGS. 1-3, 8, and 13 as described above.

Figure 5:
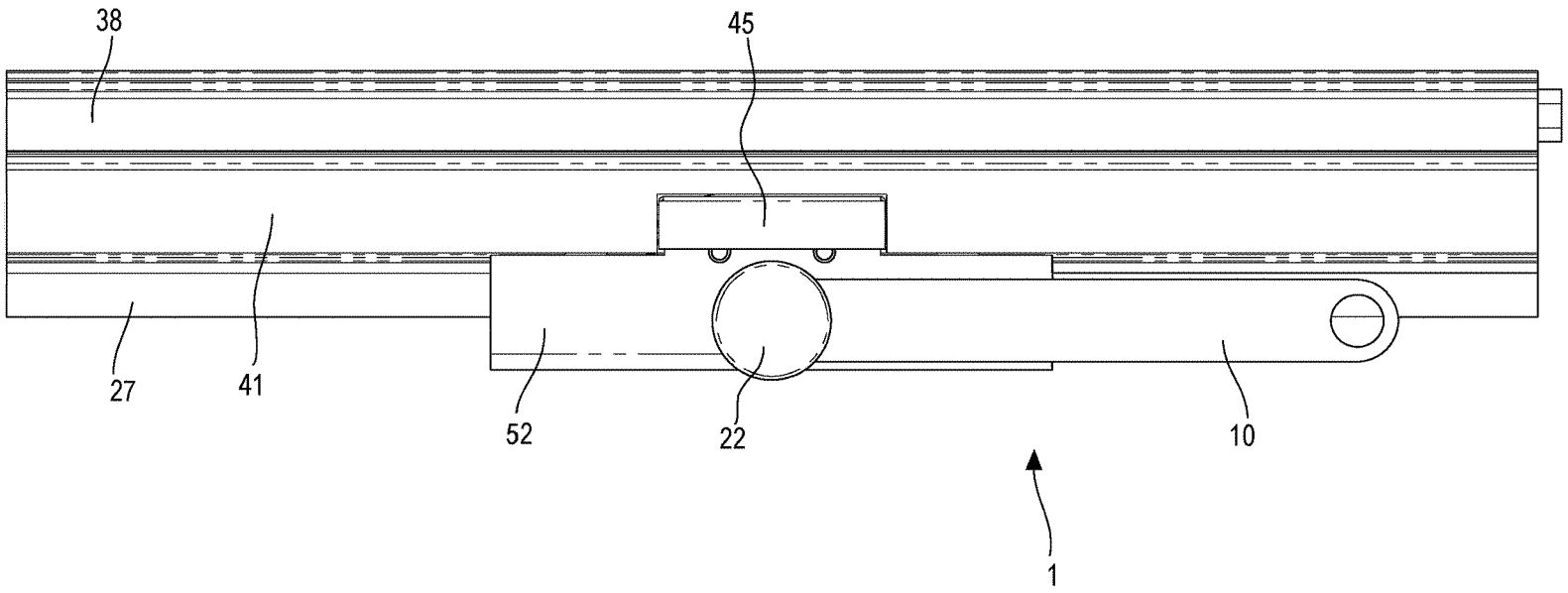
FIG. 5 is a diagram that illustrates a plan view of an exemplary lever mechanism in a locked/closed position in accordance with an embodiment of the present invention.
Figure 10:
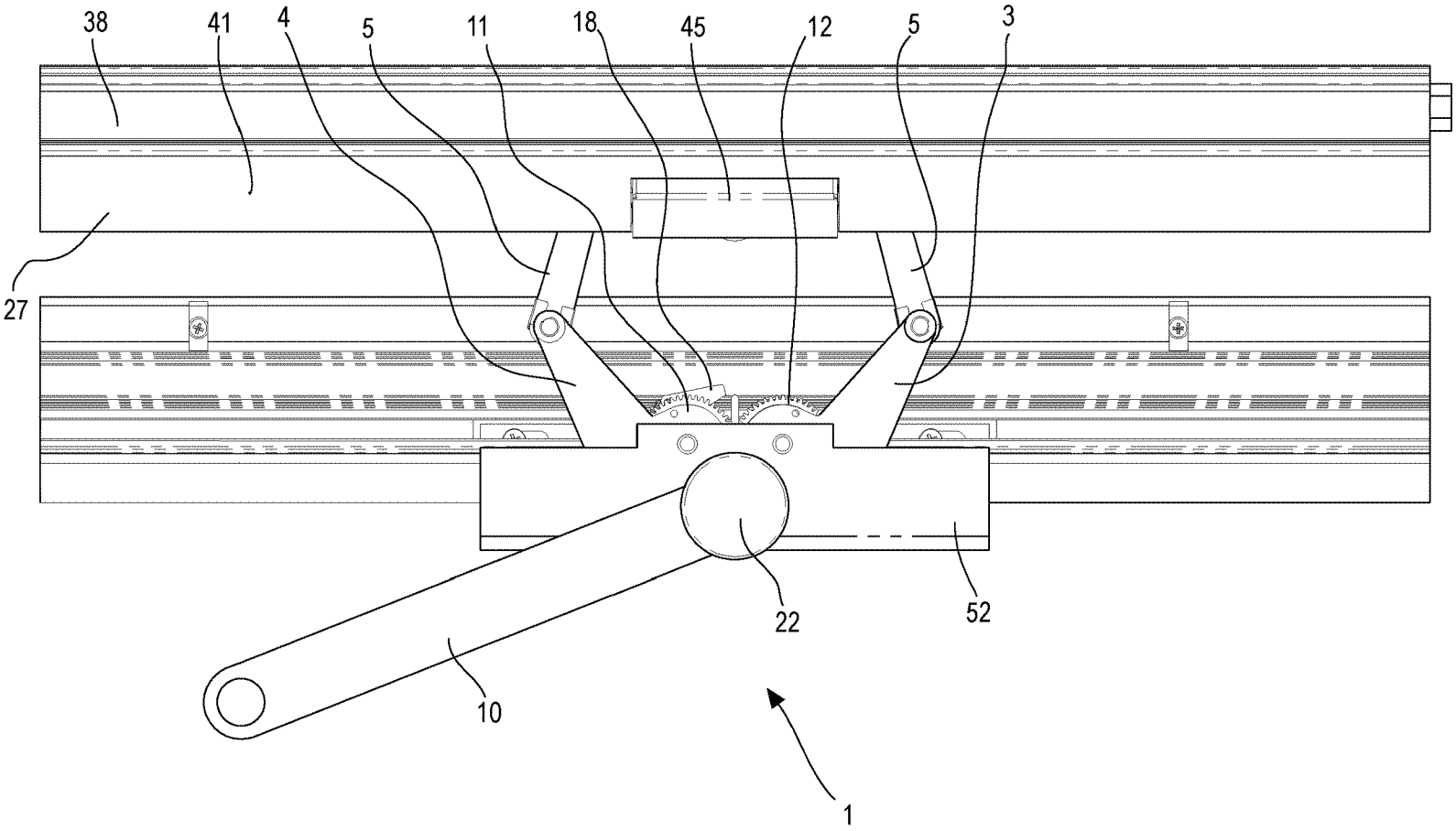
FIG. 10 is a diagram that illustrates a plan view of an unlocked exemplary lever mechanism being moved to an open position in accordance with an embodiment of the present invention.
Figure 15:
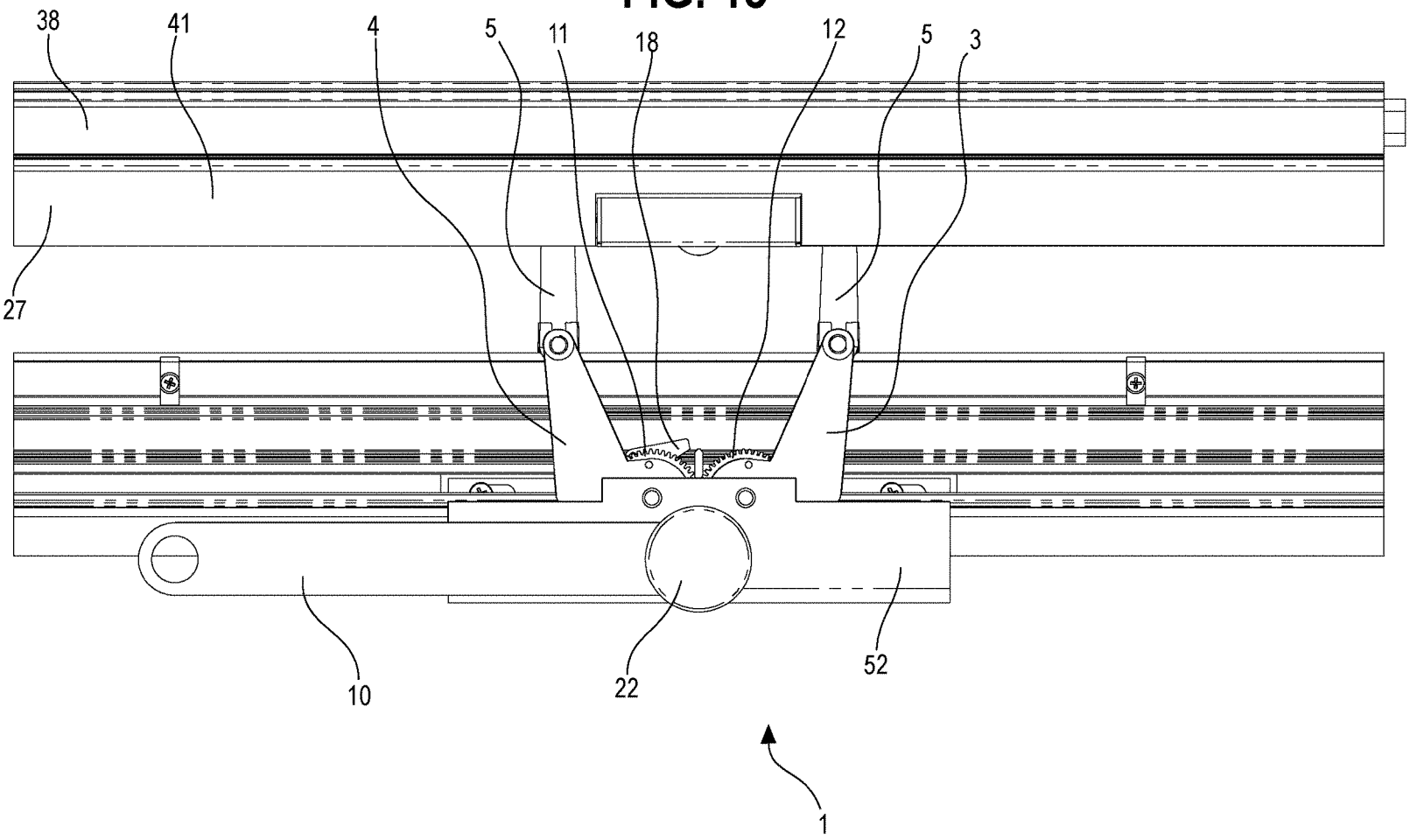
FIG. 15 is a diagram that illustrates a plan view of an exemplary lever mechanism in an unlocked/open position in accordance with an embodiment of the present invention.

FIG. 5 is a diagram that illustrates a plan view of an exemplary lever mechanism 1 in a locked/closed position in accordance with an embodiment of the present invention. FIG. 10 is a diagram that illustrates a plan view of an unlocked exemplary lever mechanism 1 being moved to an open position in accordance with an embodiment of the present invention. FIG. 15 is a diagram that illustrates a plan view of an exemplary lever mechanism 1 in an unlocked/open position in accordance with an embodiment of the present invention. Referring to FIGS. 5, 10, and 15, there is shown a lever mechanism 1 and a vent sash 27.

The vent sash 27 comprises infill 38 and glazing beading 41. The glazing beading 41 can include a flip cover 45 for allowing access to a locking mechanism when the vent sash 27 is closed and to provide a clean finish by hiding the locking mechanism when the vent sash 27 is open. The lever mechanism 1 comprises a frame 52, drive arms, 3, 4, push arms 5, gears 11, 12, locking hook 18, and a handle 10. The drive arms 3, 4 may be pivotably attached to push arms 5. The gears 11, 12 can be configured to drive arms 3-5 to push a vent sash 27 open or pull it closed. The locking hook 18 may seal the vent sash 27 when the vent sash 27 is in a closed position. The handle 10 can include a cap 22 to provide a clean finish by hiding the connection between the handle 10 and the other components of the lever mechanism 1. The frame 52 may attach to the window frame 26 and houses and protects components of the lever mechanism 1.

As illustrated in FIG. 5, the handle 10 is in an exemplary position where the vent sash 27 is locked and closed. As illustrated in FIG. 10, the handle 10 is in an exemplary position where the vent sash 27 is unlocked and in the process of being opened. As illustrated in FIG. 15, the handle 10 is in an exemplary position where the vent sash 27 is unlocked and fully open. The lever mechanism 1 illustrated in FIGS. 5, 10, and 15 shares various characteristics with the lever mechanism 1 illustrated in FIGS. 1-4, 8-9, and 13-14 as described above.

Figure 6:
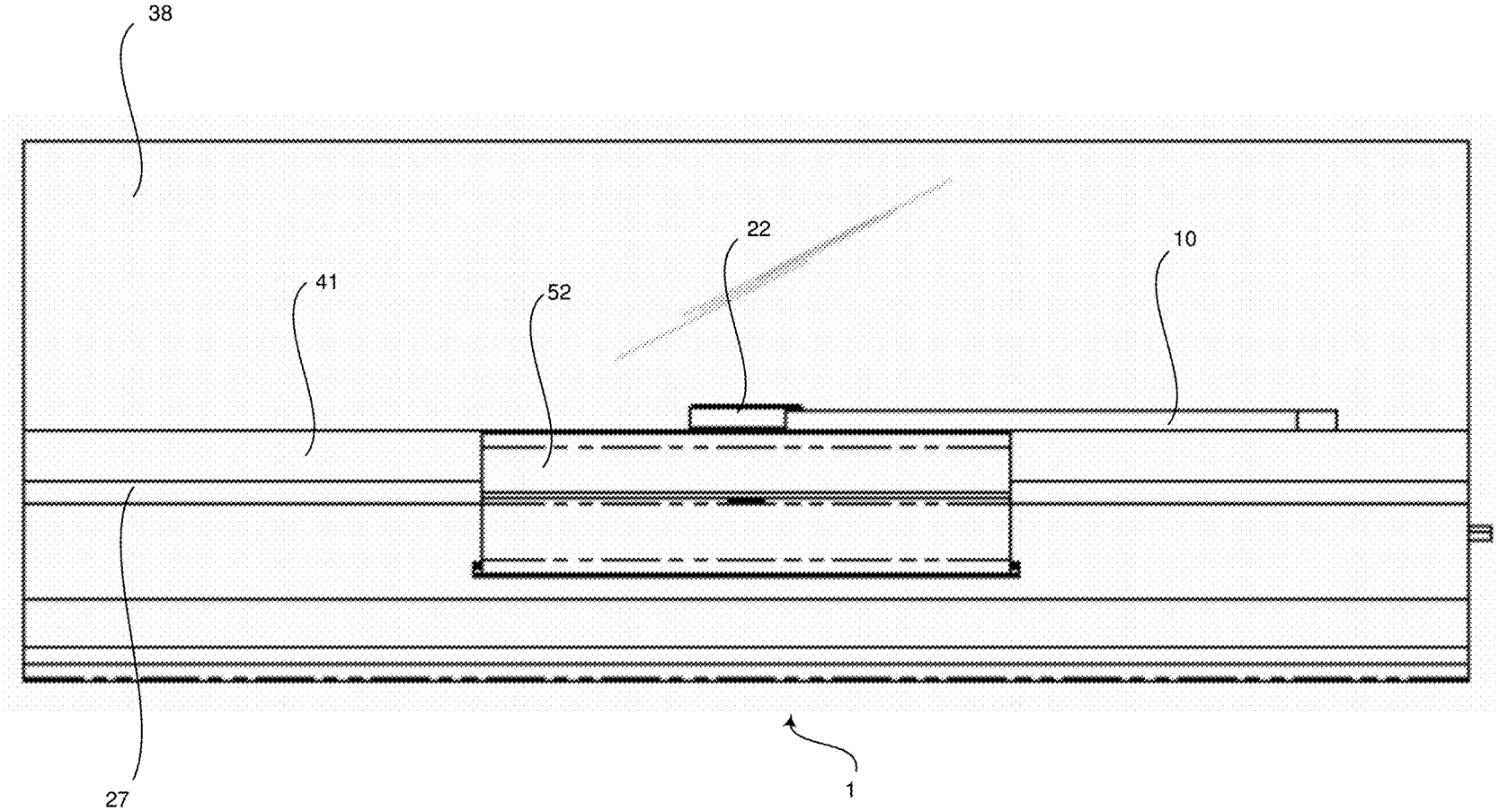
FIG. 6 is a diagram that illustrates a front view of an exemplary lever mechanism in a locked/closed position in accordance with an embodiment of the present invention.
Figure 11:
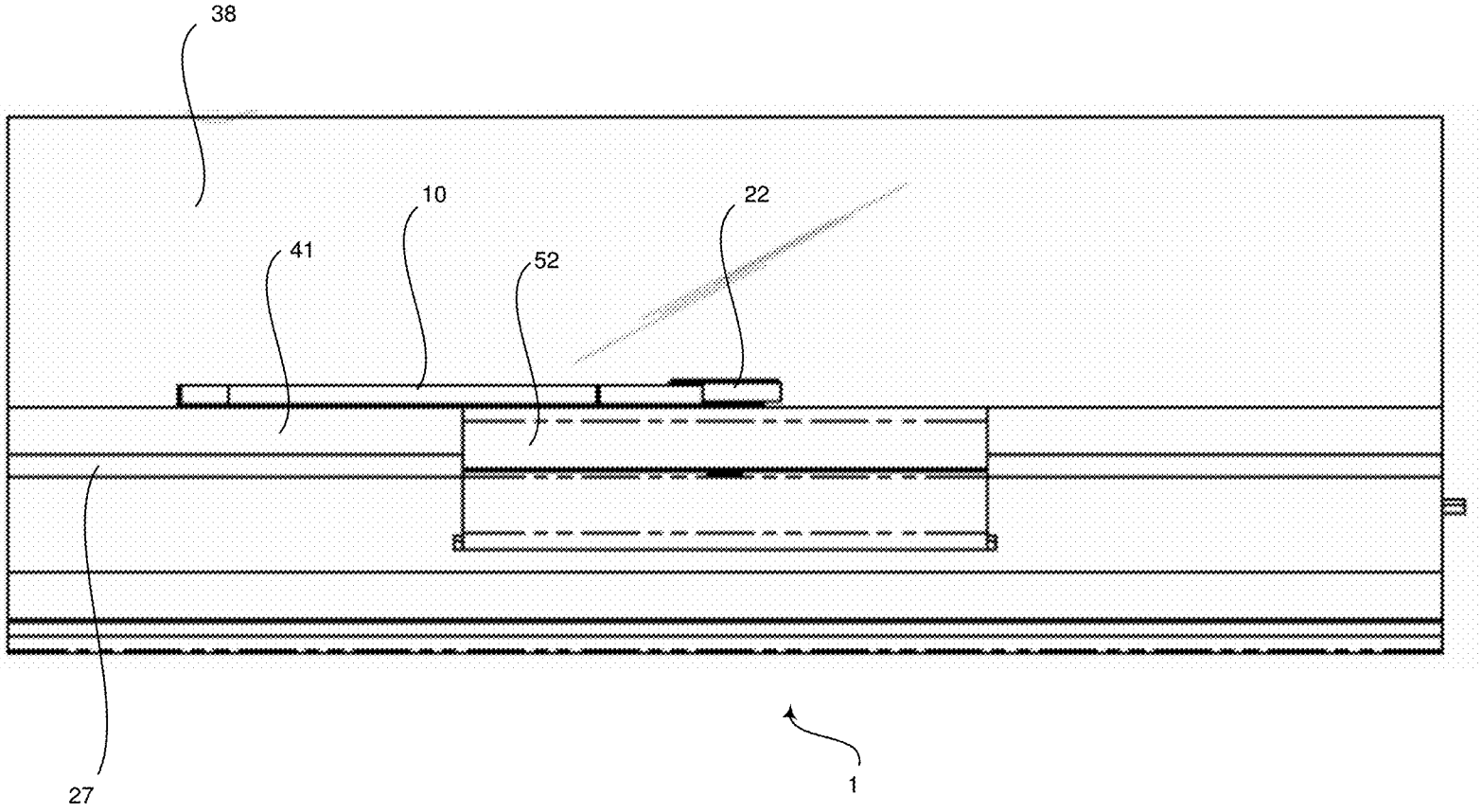
FIG. 11 is a diagram that illustrates a front view of an unlocked exemplary lever mechanism being moved to an open position in accordance with an embodiment of the present invention.
Figure 16:
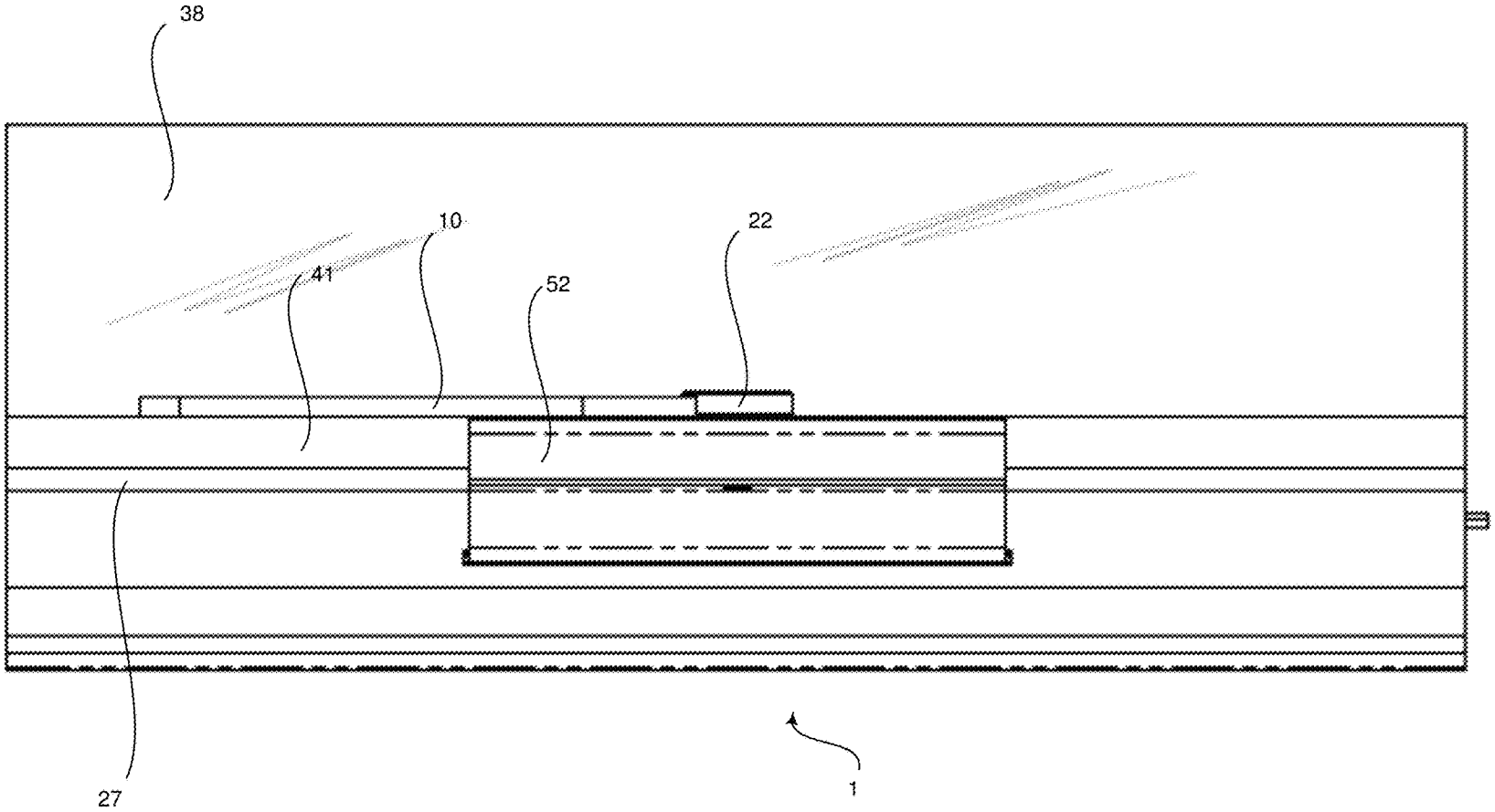
FIG. 16 is a diagram that illustrates a front view of an exemplary lever mechanism in an unlocked/open position in accordance with an embodiment of the present invention.

FIG. 6 is a diagram that illustrates a front view of an exemplary lever mechanism 1 in a locked/closed position in accordance with an embodiment of the present invention. FIG. 11 is a diagram that illustrates a front view of an unlocked exemplary lever mechanism 1 being moved to an open position in accordance with an embodiment of the present invention. FIG. 16 is a diagram that illustrates a front view of an exemplary lever mechanism 1 in an unlocked/open position in accordance with an embodiment of the present invention. Referring to FIGS. 6, 11, and 16, there is shown a lever mechanism 1 and a vent sash 27.

The vent sash 27 comprises infill 38 and glazing beading 41. The lever mechanism 1 comprises a frame 52 and a handle 10. The handle 10 can include a cap 22 to provide a clean finish by hiding the connection between the handle 10 and the other components of the lever mechanism 1. The frame 52 may attach to the window frame 26 and houses and protects components of the lever mechanism 1.

As illustrated in FIG. 6, the handle 10 is in an exemplary position where the vent sash 27 is locked and closed. As illustrated in FIG. 11, the handle 10 is in an exemplary position where the vent sash 27 is unlocked and in the process of being opened. As illustrated in FIG. 16, the handle 10 is in an exemplary position where the vent sash 27 is unlocked and fully open. The lever mechanism 1 illustrated in FIGS. 6, 11, and 16 shares various characteristics with the lever mechanism 1 illustrated in FIGS. 1-5, 8-10, and 13-15 as described above.

Figure 7:
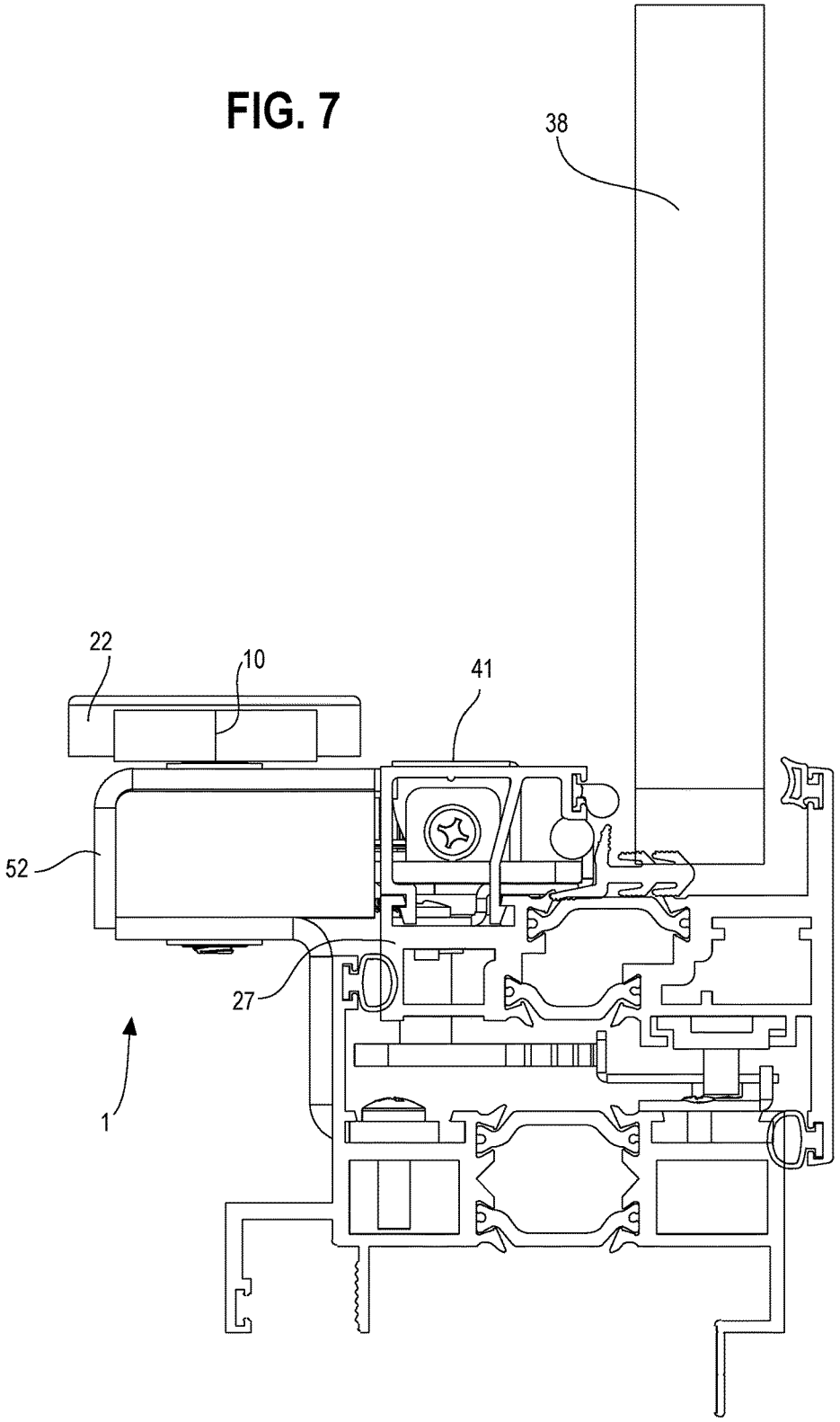
FIG. 7 is a diagram that illustrates a side view of an exemplary lever mechanism in a locked/closed position in accordance with an embodiment of the present invention.
Figure 12:
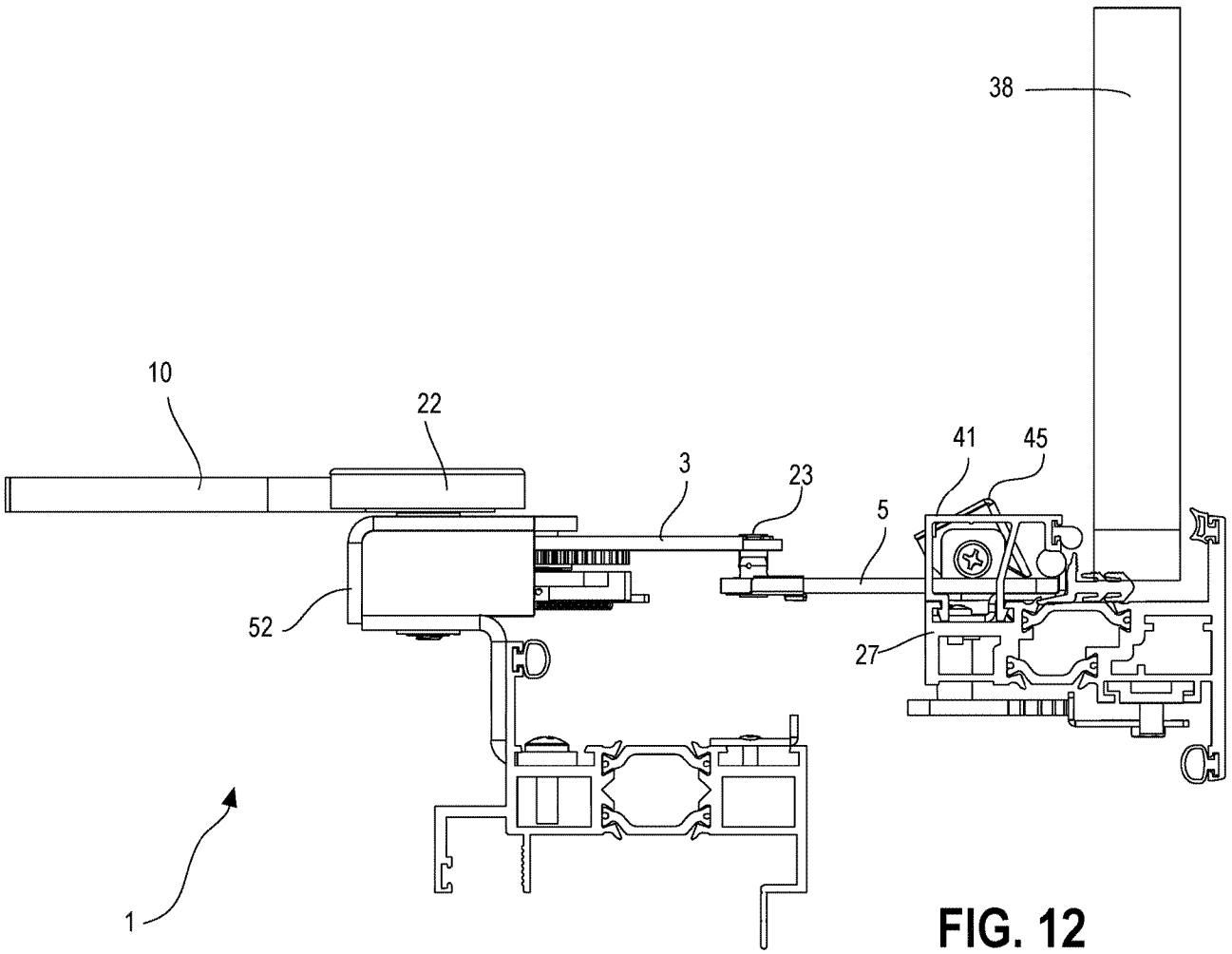
FIG. 12 is a diagram that illustrates a side view of an unlocked exemplary lever mechanism being moved to an open position in accordance with an embodiment of the present invention.
Figure 17:
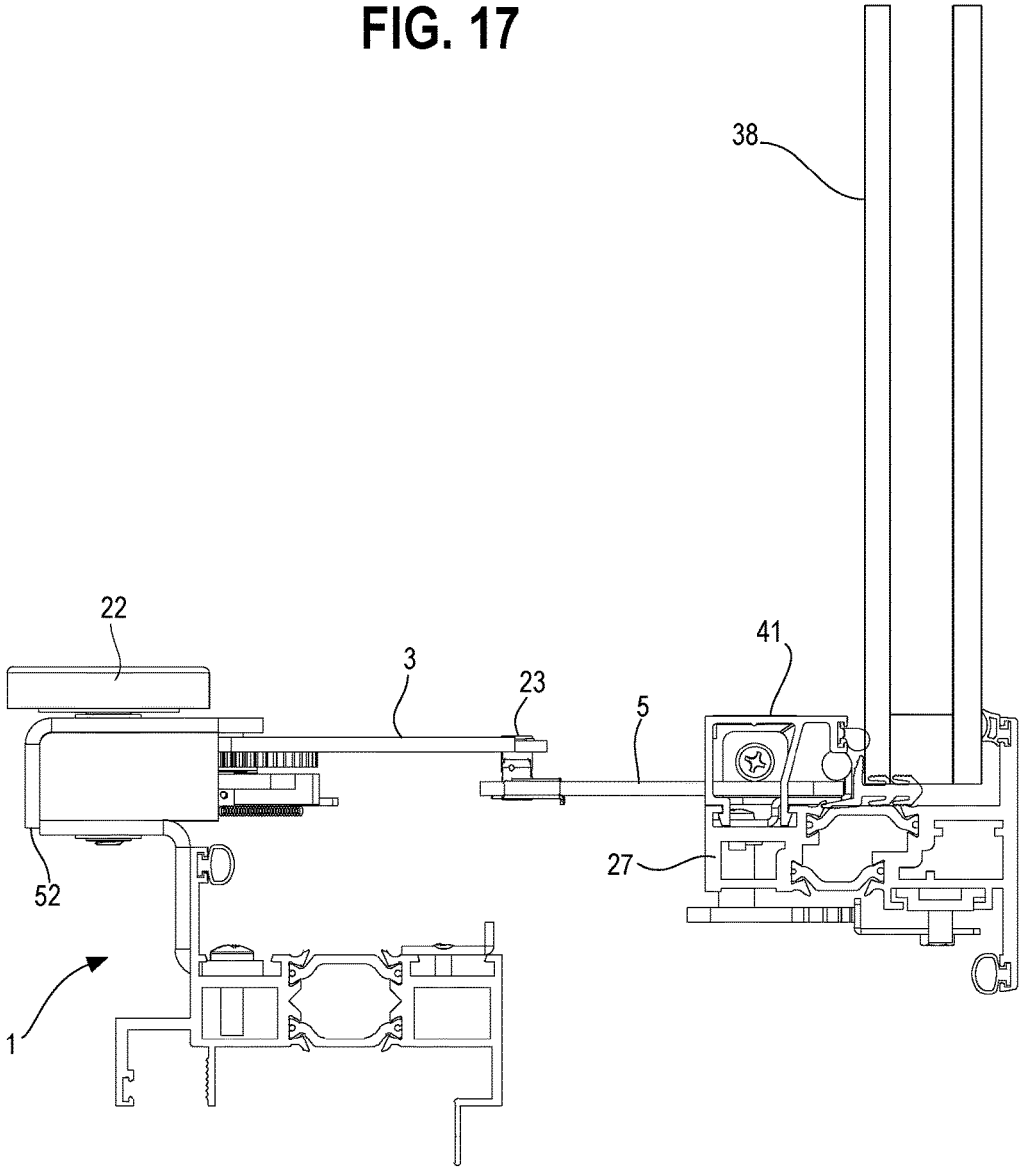
FIG. 17 is a diagram that illustrates a side view of an exemplary lever mechanism in an unlocked/open position in accordance with an embodiment of the present invention.

FIG. 7 is a diagram that illustrates a side view of an exemplary lever mechanism 1 in a locked/closed position in accordance with an embodiment of the present invention. FIG. 12 is a diagram that illustrates a side view of an unlocked exemplary lever mechanism 1 being moved to an open position in accordance with an embodiment of the present invention. FIG. 17 is a diagram that illustrates a side view of an exemplary lever mechanism 1 in an unlocked/open position in accordance with an embodiment of the present invention. Referring to FIGS. 7, 12, and 17, there is shown a lever mechanism 1 and a vent sash 27.

The vent sash 27 comprises infill 38 and a glazing beading 41. The infill 38 may be held in place by glazing beading 41. The glazing beading 41 can include a flip cover 45 for allowing access to a locking mechanism when the vent sash 27 is closed and to provide a clean finish by hiding the locking mechanism when the vent sash 27 is open. The lever mechanism 1 comprises a frame 52, drive arms, 3, 4, push arms 5, and a handle 10. The drive arms 3, 4 may be pivotably attached to push arms 5 by hinged pins 23. The handle 10 is rotated in a first direction to drive the components of the lever mechanism 1 to unlock and open the vent sash 27. The handle 10 is rotated in a second direction, opposite the first direction, to close and lock the vent sash 27. The handle 10 can include a cap 22 to provide a clean finish by hiding the connection between the handle 10 and the other components of the lever mechanism 1. The frame 52 houses and protects components of the lever mechanism 1 while providing an aesthetically-pleasing clean finish.

As illustrated in FIG. 7, the handle 10 is in an exemplary position where the vent sash 27 is locked and closed. As illustrated in FIG. 12, the handle 10 is in an exemplary position where the vent sash 27 is unlocked and in the process of being opened. As illustrated in FIG. 17, the handle 10 is in an exemplary position where the vent sash 27 is unlocked and fully open. The lever mechanism 1 illustrated in FIGS. 7, 12, and 17 shares various characteristics with the lever mechanism 1 illustrated in FIGS. 1-6, 8-11, and 13-16 as described above.

Although FIGS. 3-17 illustrate the handle 10 of lever mechanism 1 pivoting in a first direction (e.g., from right to left) to unlock and open the vent sash 27 and pivoting in a second direction (e.g., from left to right) to close and lock the vent sash 27, in certain embodiments the lever mechanism may be configured to pivot in the opposite directions (e.g., from left to right to unlock and open the vent sash 27, and from right to left to close and lock the vent sash 27), among other things (e.g., from up to down to unlock and open the vent sash 27, and from down to up to close and lock the vent sash 27, or vice versa), by reconfiguring and/or rotating components of the lever mechanism 1, for example.

Figure 18:
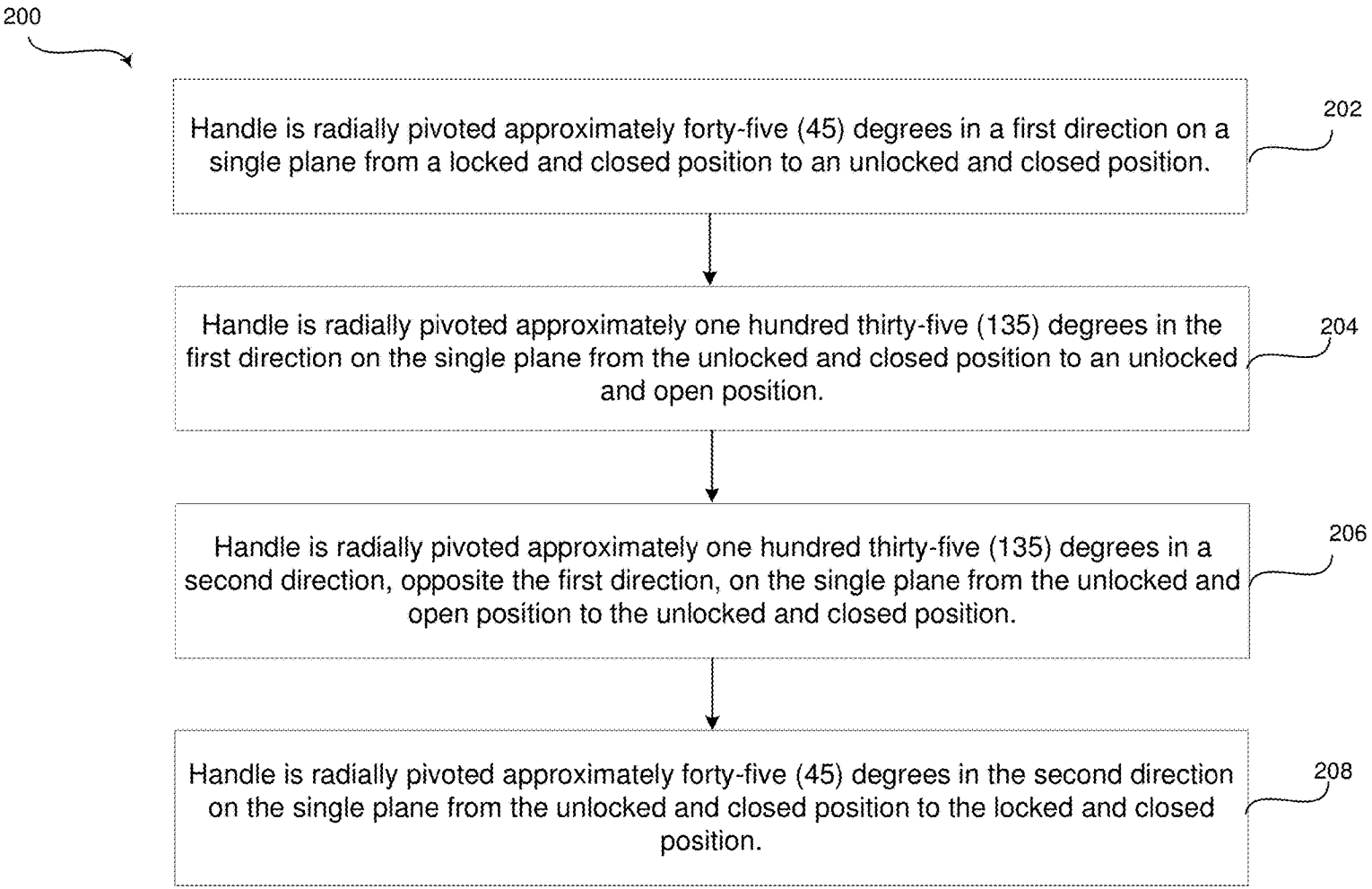
FIG. 18 is a flow diagram that illustrates exemplary steps for unlocking, opening, closing and locking a vent sash in accordance with an embodiment of the present invention.

FIG. 18 is a flow diagram that illustrates exemplary steps for unlocking, opening, closing, and locking a vent sash 27 in accordance with an embodiment of the present invention. Referring to FIG. 18, there is shown a flow diagram 200, which illustrates exemplary steps for unlocking, opening, closing and locking a vent sash 27. At step 202, a handle 10 is radially pivoted approximately forty-five (45) degrees in a first direction on a single plane from a locked and closed position to an unlocked and closed position. At step 204, the handle 10 is radially pivoted approximately one hundred thirty-five (135) degrees in the first direction on the single plane from the unlocked and closed position to an unlocked and open position. At step 206, the handle 10 is radially pivoted approximately one hundred thirty-five (135) degrees in a second direction, opposite the first direction, on the single plane from the unlocked and open position to the unlocked and closed position. At step 208, the handle 10 is radially pivoted approximately forty-five (45) degrees in the second direction on the single plane from the unlocked and closed position to the locked and closed position. Although the method is described with reference to the exemplary elements of the systems described above, it should be understood that other implementations are possible.

At step 202, a handle 10 is radially pivoted approximately forty-five (45) degrees in a first direction on a single plane from a locked and closed position to an unlocked and closed position. For example, when unlocking and opening the vent sash 27 from a closed and locked position, the handle 10 is grasped and rotated in a first direction. As the handle 10 is rotated, the shoulder screw 9 rotates the drive gear 13, cam gear 14, and locking arm 19. During the first approximately 45 degrees of rotation, the locking arm 19 rotates away from the locking hook 18 causing the locking pin 31 to release the locking hook 18. The locking hook 18 is biased by spring 24 to an open position causing the locking hook 18 to unlatch from behind the locking spindle 30 thereby releasing the sealed vent sash 27.

The cam gear 14 rotates in unison with the locking arm 19 on the shoulder screw 9. The cam gear 14 engages the locking gear slide 20 teeth during the first approximately 45 degrees of handle 10 rotation to slide the gear slide 20 protrusion thereby rotating the locking spindle 30 to an unlocked position. As the locking spindle 30 rotates to an unlocked position, it pivots rack gear 29. The rack gear 29 slides the rack 34 coupled to the transmission bar 36 such that the locking points 43 of the transmission bar 36 are released from keepers 42 of the window frame 26, unlocking the vent sash 27. Although drive gear 13 rotates on the shoulder screw 9 as the handle is rotated, the teeth of the drive gear 13 are configured so as not to engage the gear 12 until after the vent sash is unlocked (i.e., not until after the first approximately 45 degrees of rotation). The pin 32 of gear 11 is engaged with the central open slot of the locking gear slide 20 during the first approximately 45 degrees of rotation to prevent the rotation of gear 11. After the first approximately 45 degrees, the pin 32 is released through the opening in the central open slot of the gear slide 20 thereby allowing rotation of the gear 11.

At step 204, the handle 10 is radially pivoted approximately one hundred thirty-five (135) degrees in the first direction on the single plane from the unlocked and closed position to an unlocked and open position. Once the vent sash is unlocked by rotating the handle 10 the first approximately 45 degrees, the vent sash 27 is opened as the handle 10 is rotated the remaining approximately 135 degrees of a complete approximately 180 degree handle 10 rotation. The shoulder screw 9 continues to rotate the drive gear 13, cam gear 14, and locking arm 19 as the handle 10 is rotated. The cam gear 14 and locking arm 19, however, do not engage other components while the vent sash 27 is moving open. The drive gear 13, on the other hand, meshes with gear 12 to drive the gear 12 and the gear 11 that is engaged with the gear 12. Gears 11, 12 are rotated to extend the drive arms 3, 4 and the push arms 5 that are attached to the drive arms 3, 4 via hinged pins 23. The push arms 5, attached to the vent sash 27 by hinge mechanisms 6-8, push the vent sash 27 to an open position. As the vent sash 27 is pushed open, the flip cover 45 is biased to a closed position by torsion spring 49 to provide a clean finish by hiding the locking spindle 30.

At step 206, the handle 10 is radially pivoted approximately one hundred thirty-five (135) degrees in a second direction, opposite the first direction, on the single plane from the unlocked and open position to the unlocked and closed position. For example, when closing and locking the vent sash 27 from an open and unlocked position, the handle 10 is grasped and rotated in a second direction that is opposite from the first direction used to unlock and open the vent sash 27. The vent sash 27 is closed as the handle 10 is rotated the first approximately 135 degrees of a complete approximately 180 degree handle 10 rotation in the second direction. The shoulder screw 9 rotates the drive gear 13, cam gear 14, and locking arm 19 as the handle 10 is rotated. The cam gear 14 and locking arm 19 may not engage other components while the vent sash 27 is moving closed (i.e., during the first approximately 135 degrees of handle 10 rotation in the second direction). As the drive gear 13 rotates on the shoulder screw 9, the teeth of the drive gear 13 are configured to engage the gear 12 during the first approximately 135 degrees of rotation in the second direction. The drive gear 13 meshes with gear 12 to drive the gear 12 and the gear 11 that is engaged with the gear 12. Gears 11, 12 are rotated to retract the drive arms 3, 4 and the push arms 5 that are attached to the drive arms 3, 4 via hinged pins 23. The push arms 5, attached to the vent sash 27 by hinge mechanisms 6-8, pull the vent sash 27 to a closed position. After the first approximately 135 degrees of handle 10 rotation, the pin 32 of gear 11 slides into the opening in the central open slot of the gear slide 20 to prevent rotation of the gear 11.

As the vent sash 27 is pulled closed, the flip cover 45 is forced open by a flip cover rotation mechanism to provide access to the locking spindle 30 by the protrusion of the locking gear slide 20. The flip cover rotation mechanism may be bevel gears, a key 47 and key shaft 51, or any suitable mechanism for rotating the flip cover 45 to an open position. For example, a key 47 may extend into an aperture in the flip cover 45 and be attached to a push arm 5 by a key shaft 51. As the push arm 5 is pivoted to pull the vent sash 27 closed, the key 47 may be partially pulled out of the flip cover 45 aperture to force the flip cover 45 open.

At step 208, the handle 10 is radially pivoted approximately forty-five (45) degrees in the second direction on the single plane from the unlocked and closed position to the locked and closed position. The vent sash 27 is locked as the handle 10 is rotated the last approximately 45 degrees of handle 10 rotation. The cam gear 14 engages the locking gear slide 20 teeth during the last approximately 45 degrees of handle 10 rotation to slide the gear slide 20 protrusion. The gear slide 20 protrusion rotates the locking spindle 30 to a locked position. As the locking spindle 30 rotates to a locked position, it pivots rack gear 29. The rack gear 29 slides the rack 34 coupled to the transmission bar 36 such that the locking points 43 of the transmission bar 36 are engaged with keepers 42 of the window frame 26, locking the vent sash 27. During the last approximately 45 degrees of rotation, the locking arm 19 rotates toward the locking hook 18 causing the locking pin 31 to engage the locking hook 18. The locking pin 31 pushes the locking hook 18 to a closed position such that the locking hook 18 latches behind the locking spindle 30 to seal the vent sash 27.

In certain embodiments, by configuring the handle 10 length, the force required to pivot the lever mechanism 1, to both unlock/open and close/lock the vent sash 27, does not exceed five (5) pounds (lbs.), irrespective of the size and weight of the vent sash 27. In various embodiments, pivoting the lever mechanism 1 approximately one hundred eighty (180) degrees on a single plane in a first direction to unlock/open a vent sash 27, and pivoting the lever mechanism 1 approximately one hundred eighty (180) degrees on the same single plane in a second direction to close/lock the vent sash 27 does not involve excessive twisting or turning of an operator's wrist.

Aspects of the present invention provide that the lever mechanism 1 may be retrofitted to replace an existing vent handle 101 such that the lever mechanism 1 operates with an existing locking mechanism of a vent sash 27. Additionally and/or alternatively, the lever mechanism 1 may be manufactured as a part of a locking mechanism of a vent sash 27. Additionally and/or alternatively, the lever mechanism 1 may be manufactured to be integrated within a window frame 26 and attached to a locking mechanism of a vent sash 27.

In various embodiments, the drive arms 3, 4, and/or push arms 5 may restrict or limit the distance the vent sash 27 may open. Further, the drive arms 3, 4, and/or push arms 5 can help secure and support the vent sash 27 such that it does not blow out from negative pressure when in an open position.

In certain embodiments, the lever mechanism 1 may be operable to pivot approximately one hundred eighty (180) degrees in substantially the horizontal plane (i.e., within ten degrees in either direction of a plane that is parallel to the base of the vent sash 27 or window frame 26, for example) such that the lever mechanism 1 is accessible at a particular height for all operations (e.g., unlocking, opening, closing and locking).

Aspects of the present invention provide a lever mechanism system 1 for unlocking, opening, closing and locking a vent sash 27. The lever mechanism system 1 may comprise push arms 5, drive arms 3, 4, gears 11, 12, a locking gear slide 20, and a handle 10. Each of the push arms 5 comprises a first push arm end and a second push arm end. Each of the push arms 5 pivotably couples to the vent sash 27 at the second push arm end. Each of the drive arms 3, 4 comprises a first drive arm end and a second drive arm end. Each of the drive arms 3, 4 pivotably couples at the second drive arm end to the first push arm end of a corresponding one of the push arms. Each of the gears 11, 12 is coupled to the first drive arm end of a corresponding one of the drive arms 3, 4. The locking gear slide 20 is operable to interface with a locking mechanism of the vent sash 27. The handle 10 is operable to radially rotate approximately one hundred eighty degrees in a first direction on a single plane to pivot the locking gear slide 20 to move the locking mechanism of the vent sash 27 to an unlocked position, and rotate the gears 11, 12 to extend the drive arms 3, 4, and the push arms 5 such that the vent sash 27 is pushed to an open position. The handle 10 is operable to radially rotate approximately one hundred eighty degrees in a second direction on the single plane to rotate the gears 11, 12 to retract the drive arms 3, 4 and the push arms 5 such that the vent sash 27 is pulled to a closed position, and pivot the locking gear slide 20 to move the locking mechanism of the vent sash 27 to a locked position.

In a representative embodiment, the lever mechanism system 1 comprises a frame 52 configured to mount to a window frame 26 and house at least a portion of the lever mechanism system 1. In certain embodiments, the second direction is opposite the first direction. In various embodiments, the handle 10 is at least one of telescopic, collapsible, and foldable.

In certain embodiments, the locking gear slide 20 is pivoted to move the locking mechanism of the vent sash 27 to the unlocked position during a first approximately forty-five degrees of the approximately one hundred eighty degrees rotation in the first direction. In a representative embodiment, the gears 11, 12 are rotated to extend the drive arms 3, 4 and the push arms 5 such that the vent sash 27 is pushed to the open position during a second approximately one hundred thirty-five degrees after the first approximately forty-five degrees of the approximately one hundred eighty degrees rotation in the first direction.

In various embodiments, the gears 11, 12 are rotated to retract the drive arms 3, 4 and the push arms 5 such that the vent sash 27 is pulled to the closed position during a first approximately one hundred thirty-five degrees of the approximately one hundred eighty degrees rotation in the second direction. In certain embodiments, the locking gear slide 20 is pivoted to move the locking mechanism of the vent sash 27 to the locked position during a second approximately forty-five degrees after the first approximately one hundred thirty-five degrees of the approximately one hundred eighty degrees rotation in the second direction.

In a representative embodiment, the locking mechanism comprises a locking spindle 30 that is pivotable by a protrusion of the locking gear slide 20. In various embodiments, the lever mechanism system 1 comprises a locking hook 18 operable to wrap behind the locking spindle 30 to seal the vent sash 27 in the closed position. In certain embodiments, the lever mechanism system 1 comprises a locking arm 19 operable to engage and move the locking hook 18 to a closed position where the locking hook 18 wraps behind the locking spindle 30 when the handle 10 is rotated in the second direction. In a representative embodiment, the lever mechanism system 1 comprises a spring 24 operable to bias the locking hook 18 to an open position when the handle 10 is rotated in the first direction causing the locking arm 19 to disengage the locking hook 18.

In certain embodiments, the lever mechanism system 1 comprises a hinged pin 23 pivotably coupling each of the drive arms 3, 4 at the second drive arm end to the first push arm end of each of the corresponding one of the push arms 5. The hinged pin 23 allows each of the push arms 5 to pivot both parallel and perpendicular to each of the corresponding one of the drive arms 3, 4. In various embodiments, the lever mechanism system 1 comprises a quick release lock 28 detachably coupling each of the drive arms 3, 4 at the second drive arm end to the first push arm end of each of the corresponding one of the push arms 5. In a representative embodiment, the lever mechanism system 1 comprises a hinge 6-8 pivotably coupling each of the push arms 5 to the vent sash 27 at the second push arm end.

In various embodiments, at least one of the gears 11, 12 comprises a pin 32 releasably coupling with the locking gear slide 20 to prevent rotation of the at least one of the gears 11, 12 during a first approximately forty-five degrees of the approximately one hundred eighty degrees of rotation of the handle 10 in the first direction and during the last approximately forty-five degrees of the approximately one hundred eighty degrees of rotation of the handle 10 in the second direction. In certain embodiments, the lever mechanism system 1 comprises a shoulder screw 9 coupled to the handle 10 at a pivot point of the handle 10 and operable to rotate with rotation of the handle 10.

In a representative embodiment, the lever mechanism system 1 comprises a drive gear 13 and a cam gear 14. The drive gear 13, the cam gear 14, and the locking arm 19 attach to and rotate with the shoulder screw 9. In certain embodiments, the drive gear 13 is operable to mate with and rotate at least one of the gears 11, 12 during a last approximately one hundred thirty-five degrees of the approximately one hundred eighty degrees of rotation of the handle 10 in the first direction and during the first approximately one hundred thirty-five degrees of the approximately one hundred eighty degrees of rotation of the handle 10 in the second direction. In various embodiments, the cam gear 14 is operable to mate with and pivot the locking gear slide 20 during a first approximately forty-five degrees of the approximately one hundred eighty degrees of rotation of the handle 10 in the first direction and during the last approximately forty-five degrees of the approximately one hundred eighty degrees of rotation of the handle 10 in the second direction.

In certain embodiments, the lever mechanism system 1 comprises a flip cover 45 pivotably mounted to the vent sash 27. The flip cover 45 pivots between a flip cover open position to provide access to the locking mechanism when the vent sash 27 is in the closed position and a flip cover closed position when the vent sash 27 is in the open position. In a representative embodiment, the flip cover 45 is pivoted by one or more of a torsion spring 49, a key 47 and a key shaft 51, and bevel gears.

Although devices, methods, and systems according to the present invention may have been described in connection with a preferred embodiment, it is not intended to be limited to the specific form set forth herein, but on the contrary, it is intended to cover such alternative, modifications, and equivalents, as can be reasonably included within the scope of the invention as defined by this disclosure and appended diagrams.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A lever mechanism system for a vent sash, the system comprising:

a plurality of push arms, each of the plurality of push arms comprising a first push arm end and a second push arm end, and each of the plurality of push arms pivotably coupled to the vent sash at the second push arm end;

a plurality of drive arms, each of the plurality of drive arms comprising a first drive arm end and a second drive arm end, each of the plurality of drive arms pivotably coupled at the second drive arm end to the first push arm end of a corresponding one of the plurality of push arms;

a plurality of first gears, each of the plurality of first gears coupled to the first drive arm end of a corresponding one of the plurality of drive arms;

a locking gear slide operable to interface with a locking mechanism of the vent sash; and a handle operable to:

radially rotate approximately one hundred eighty degrees in a first direction in a single plane to:

pivot the locking gear slide to move the locking mechanism of the vent sash to an unlocked position, and rotate the plurality of first gears to extend the plurality of drive arms and the plurality of push arms such that the vent sash is pushed to an open position, and radially rotate approximately one hundred eighty degrees in a second direction in the single plane to:

rotate the plurality of first gears to retract the plurality of drive arms and the plurality of push arms such that the vent sash is pulled to a closed position, and pivot the locking gear slide to move the locking mechanism of the vent sash to a locked position.

2. The lever mechanism system according to claim 1, comprising a frame configured to mount to a window frame and house at least a portion of the lever mechanism system.

3. The lever mechanism system according to claim 1, wherein the second direction is opposite the first direction.

4. The lever mechanism system according to claim 1, wherein the locking gear slide is pivoted to move the locking mechanism of the vent sash to the unlocked position during a first approximately forty-five degrees of the approximately one hundred eighty degrees of rotation in the first direction.

5. The lever mechanism system according to claim 4, wherein the plurality of first gears is rotated to extend the plurality of drive arms and the plurality of push arms such that the vent sash is pushed to the open position during a second approximately one hundred thirty-five degrees after the first approximately forty-five degrees of the approximately one hundred eighty degrees of rotation in the first direction.

6. The lever mechanism system according to claim 1, wherein the plurality of first gears is rotated to retract the plurality of drive arms and the plurality of push arms such that the vent sash is pulled to the closed position during a first approximately one hundred thirty-five degrees of the approximately one hundred eighty degrees of rotation in the second direction.

7. The lever mechanism system according to claim 6, wherein the locking gear slide is pivoted to move the locking mechanism of the vent sash to the locked position during a second approximately forty-five degrees after the first approximately one hundred thirty-five degrees of the approximately one hundred eighty degrees of rotation in the second direction.

8. The lever mechanism system according to claim 1, wherein the locking mechanism comprises a locking spindle that is pivotable by a protrusion of the locking gear slide.

9. The lever mechanism system according to claim 8, comprising a locking hook operable to engage the locking spindle to seal the vent sash in the closed position.

10. The lever mechanism system according to claim 9, comprising a locking arm operable to engage and move the locking hook to a closed position where the locking hook engages the locking spindle when the handle is rotated in the second direction.

11. The lever mechanism system according to claim 10, comprising a spring operable to bias the locking hook towards an open position causing the locking arm to disengage the locking hook when the handle is rotated in the first direction.

12. The lever mechanism system according to claim 1, wherein:

the open position is a fully open position, and the closed position is a fully closed position.

13. The lever mechanism system according to claim 1, comprising a plurality of hinged pins, wherein each of the plurality of hinged pins is operable to pivotably couple each of the plurality of drive arms at the second drive arm end to the first push arm end of the corresponding one of the plurality of push arms, each of the plurality of hinged pins allowing each of the plurality of push arms to pivot both parallel and perpendicular to an axis of each of the plurality of hinged pins.

14. The lever mechanism system according to claim 1, comprising a quick release lock operable to detachably couple one of the plurality of drive arms at the second drive arm end to the first push arm end of the corresponding one of the plurality of push arms.

15. The lever mechanism system according to claim 1, comprising a plurality of hinges, wherein each of the plurality of hinges is operable to pivotably couple each of the plurality of push arms to the vent sash at the second push arm end of each of the plurality of push arms.

16. The lever mechanism system according to claim 1, wherein at least one of the plurality of first gears comprises a pin releasably coupling with the locking gear slide to prevent rotation of the at least one of the plurality of first gears during a first approximately forty-five degrees of the approximately one hundred eighty degrees of rotation of the handle in the first direction and during a last approximately forty-five degrees of the approximately one hundred eighty degrees of rotation of the handle in the second direction.

17. The lever mechanism system according to claim 1, comprising a shoulder screw coupled to the handle at a pivot point of the handle and operable to rotate with rotation of the handle.

18. The lever mechanism system according to claim 17, further comprising a drive gear, a cam gear, and a locking arm, wherein the drive gear, the cam gear, and the locking arm attach to and rotate with the shoulder screw.

19. The lever mechanism system according to claim 18, wherein the drive gear is operable to mate with and rotate at least one of the plurality of first gears during a last approximately one hundred thirty-five degrees of the approximately one hundred eighty degrees of rotation of the handle in the first direction and during a first approximately one hundred thirty-five degrees of the approximately one hundred eighty degrees of rotation of the handle in the second direction.

20. The lever mechanism system according to claim 18, wherein the cam gear is operable to mate with and pivot the locking gear slide during a first approximately forty-five degrees of the approximately one hundred eighty degrees of rotation of the handle in the first direction and during a last approximately forty-five degrees of the approximately one hundred eighty degrees of rotation of the handle in the second direction.

21. The lever mechanism system according to claim 1, comprising a flip cover pivotably mounted to the vent sash, wherein the flip cover is pivotable between a flip cover open position to provide access to the locking mechanism when the vent sash is in the closed position and a flip cover closed position when the vent sash is in the open position.

22. The lever mechanism system according to claim 21, wherein the flip cover is pivoted by one or both of:

a torsion spring, and a key and a key shaft.

* * * * *